US011000121B2

(12) United States Patent
Esposito et al.

(10) Patent No.: US 11,000,121 B2
(45) Date of Patent: May 11, 2021

(54) FOLDABLE SHELF FOR STORING

(71) Applicant: SEKO S.p.A., Cittaducale (IT)

(72) Inventors: Luigino Esposito, Santa Rufina (IT); Francesco Florentino, Santa Rufina (IT); Adrio Pantaleoni, Santa Rufina (IT)

(73) Assignee: SEKO S.p.A., Santa Rufina (IT)

( * ) Notice: Subject to any disclaimer, the term of this patent is extended or adjusted under 35 U.S.C. 154(b) by 98 days.

(21) Appl. No.: 16/310,737

(22) PCT Filed: Jun. 23, 2017

(86) PCT No.: PCT/IB2017/053754
§ 371 (c)(1),
(2) Date: Dec. 17, 2018

(87) PCT Pub. No.: WO2018/002787
PCT Pub. Date: Jan. 4, 2018

(65) Prior Publication Data

US 2019/0320792 A1 Oct. 24, 2019

(30) Foreign Application Priority Data

Jun. 27, 2016 (IT) ..... UA2016A004692

(51) Int. Cl.

| | |
|---|---|
| ***A47B 43/00*** | (2006.01) |
| ***A47B 73/00*** | (2006.01) |
| ***A47K 5/12*** | (2006.01) |
| ***A47B 95/00*** | (2006.01) |

(52) U.S. Cl.
CPC ..... *A47B 43/00* (2013.01); *A47B 73/00* (2013.01); *A47B 95/008* (2013.01); *A47K 5/12* (2013.01)

(58) Field of Classification Search
CPC ..... A47B 43/00; A47B 73/00; A47B 95/008; A47B 47/042; A47L 5/12; A47K 5/12; B65D 11/1833; B65D 19/18; B65D 2519/00034; B65D 2519/00069
See application file for complete search history.

(56) References Cited

U.S. PATENT DOCUMENTS 3,784,272 A * 1/1974 Schreiber ..... A47B 47/042 312/245
4,046,439 A * 9/1977 Lee ..... A62C 13/78 312/139.2

(Continued)

OTHER PUBLICATIONS

Seko Spa: "SekureMax", May 2, 2016 (May 2, 2016), XP055358882, Retrieved from the Internet: URL http://www.seko-group.com/page/standard/mop_all.php?p_id=00197, cited in ISR mailed Nov. 2, 2017 in PCT/IB2017/053754.

(Continued)

*Primary Examiner* — Hiwot E Tefera
(74) *Attorney, Agent, or Firm* — HEA Law PLLC; Darrin A. Auito

(57) ABSTRACT

A foldable shelf is provided for storing objects, in particular for storing liquid containers, that allows in a simple, reliable, efficient, versatile and inexpensive way to support the containers, or more generally objects, protecting them from possible tampering, simplifying the operations of transportation, assembling, installation and maintenance, while reducing costs.

16 Claims, 13 Drawing Sheets

(56) References Cited

U.S. PATENT DOCUMENTS 4,591,065 A * 5/1986 Foy ..... B65D 11/1833 206/509
6,170,689 B1 * 1/2001 Flesher ..... B65D 19/06 206/508
6,398,054 B1 * 6/2002 Overholt ..... B65D 11/1833 220/1.5
7,017,766 B2 * 3/2006 Hsu ..... B65D 11/1833 220/6
7,281,637 B2 * 10/2007 Hadar ..... B65D 19/18 220/4.28
7,438,197 B2 * 10/2008 Yamauchi ..... B65D 11/1833 215/371
7,717,283 B2 * 5/2010 Apps ..... B65D 21/062 206/506
7,748,797 B2 * 7/2010 Cleveland ..... A47B 63/00 312/108
8,573,715 B1 11/2013 Jackman et al.
9,296,514 B2 * 3/2016 Ficker ..... B65D 11/1833
9,554,678 B2 * 1/2017 Wilson ..... A47K 10/424
2002/0109442 A1 * 8/2002 Hsu ..... A47B 67/04 312/263
2003/0116564 A1 * 6/2003 Overholt ..... B65D 11/1833 220/7
2006/0231555 A1 * 10/2006 Smyers ..... B65D 11/1833 220/6
2008/0169285 A1 * 7/2008 Marazita ..... B65D 19/18 220/7
2009/0134176 A1 * 5/2009 Yamauchi ..... B65D 11/1833 220/666
2009/0223953 A1 * 9/2009 Cavalcante ..... B65D 21/062 220/4.28
2010/0320202 A1 * 12/2010 Yamauchi ..... B65D 11/1833 220/6
2011/0006057 A1 * 1/2011 Cavalcante ..... B65D 11/1833 220/6
2011/0049145 A1 * 3/2011 Yamauchi ..... B65D 11/1833 220/7
2011/0221318 A1 * 9/2011 Chen ..... A47B 88/941 312/263
2013/0299490 A1 * 11/2013 Hansen ..... B65D 88/522 220/7
2014/0008255 A1 * 1/2014 Iwata ..... B65D 19/18 206/386
2014/0014675 A1 1/2014 Ingvarsson et al.
2017/0137175 A1 * 5/2017 Park ..... B65D 25/30

OTHER PUBLICATIONS

International Search Report (ISR) dated Nov. 2, 2017 in PCT/IB2017/053754.

* cited by examiner

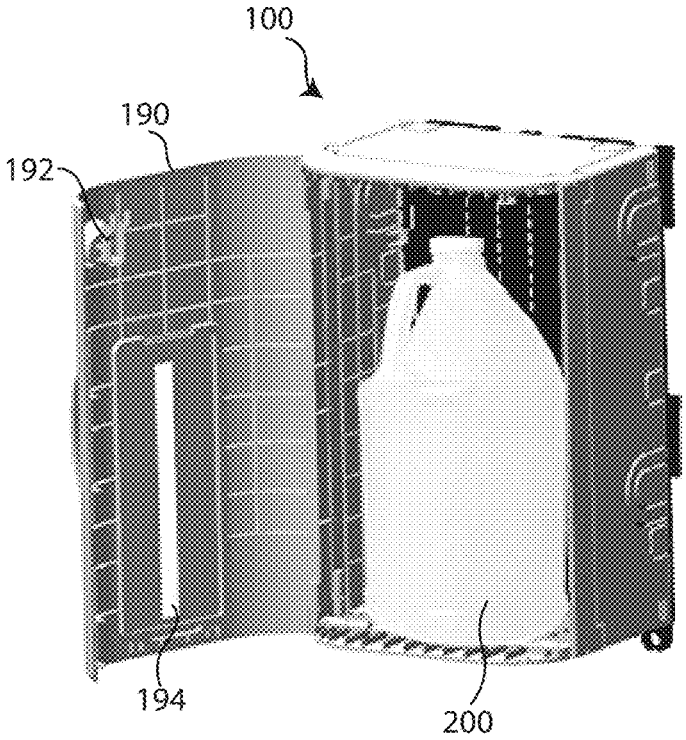
Fig. 1
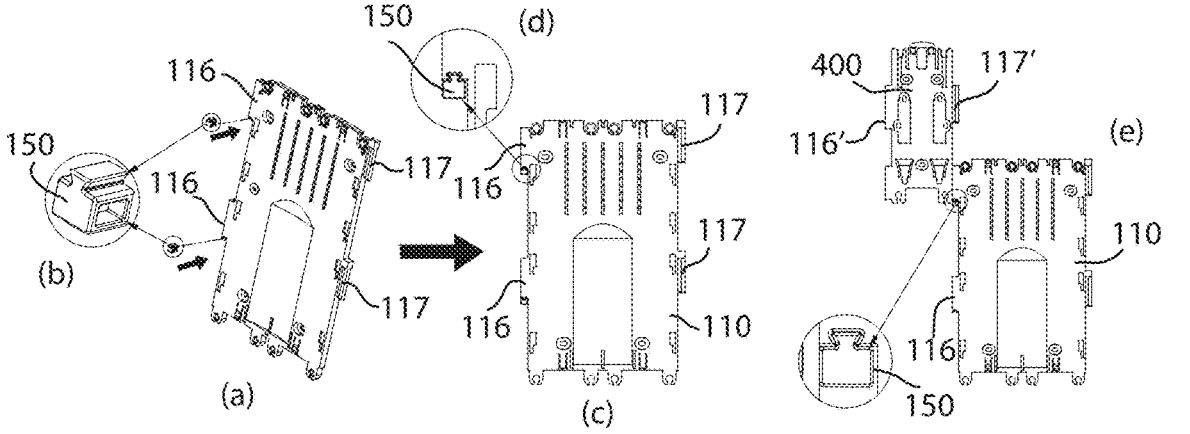
Fig. 19
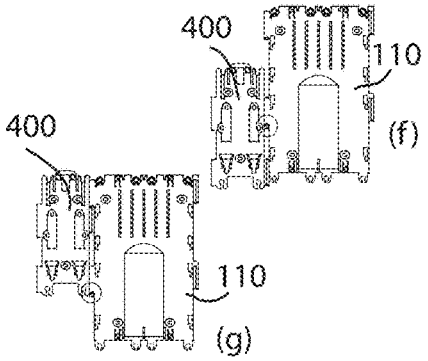

FOLDABLE SHELF FOR STORING

CROSS REFERENCE TO RELATED APPLICATIONS

This application is a National Stage of International Application No. PCT/IB2017/053754 filed on Jun. 23, 2017, claiming priority to UA2016A004692 filed on Jun. 27, 2016. The contents of the above documents are incorporated herein by reference in its entirety.

The present invention refers to a foldable shelf for storing objects, in particular for storing liquid containers, such as for instance containers containing concentrated chemicals for cleaning surfaces, that allows in a simple, reliable, efficient, versatile and inexpensive way to support the containers, or more generally objects, protecting them from possible tampering, simplifying the operations of transportation, assembling, installation and maintenance, while reducing at the same time its costs.

In the following of the present description, reference will be mainly made to a foldable shelf used for storing containers containing concentrated chemicals for cleaning surfaces. However, it must be noted that the foldable shelf according to the invention may be used for containing also containers, and more generally objects, of different type, still remaining within the scope of protection of the present invention.

It is known that mixing apparatuses are widespread. In particular, in the field of cleaning and disinfection of surfaces, such apparatuses allow both water-only treatment and addition of concentrated chemicals, such as for instance disinfectants, soaps, wet foams and dry foams. Such apparatuses comprise diluting devices (possibly manually operated pumps), provided with Venturi valves, or dosing pumps, which contribute to mixing the concentrated chemicals with water and to dispensing the obtained mixture according to accurate dosages.

In particular, the concentrated chemicals are stored in dedicated containers, from which they are drawn for mixing, which are in turn stored in container holder elements and shelves.

The holder elements and shelves support the concentrated chemical containers, which usually have a capacity equal to 1, 2.5 or 5 litres (or similar capacity according to American measurement units, namely gallons), avoiding contact with the floor, in public places or places with access limited to staff. In particular, this is 6 established by the HACCP (Hazard Analysis and Critical Control Points) protocol, that requires a high level of cleanliness of environments to prevent a possible contamination of foods, since contact of the containers with the floor would generate a point of accumulation of dirt.

Also, some prior art container holder shelves are closed and inaccessible to protect containers from undue uses and tampering. In fact, cleaning products, such as degreasers, disinfectants, detergents, sanitizers, are numerous and all potentially dangerous, most of all in case of concentrated and super concentrated chemicals (intended for professional use), whereby it is necessary to separate the containers so as to avoid the risks of contact with people and animals, even in order to reduce risks in working environments. Furthermore, the containers could be sabotaged, for instance by altering the chemicals contained therein. In this regard, the same customers of concentrated chemical vendors can occasionally not comply with the contract by autonomously getting supplies through secondary channels offering non-genuine products at lower prices, even notwithstanding the constraints usually imposed to customers through contracts of loan for use concerning dosing equipment (and container holder elements and shelves).

Currently available container holder elements and shelves are made in several ways and suffer from some drawbacks.

A first type of prior art container holder elements are the (plastic or stainless steel) container holding hook-like elements configured to be attached to a wall, to each one of which a handle of a container containing the concentrated chemical is hooked, which are inexpensive, resistant to chemical aggression, robust and which take up a very reduced space when they are stored. However, such container holding elements so not protect containers (which are easily accessible) from undue uses and tampering, the container hooked to the element is exposed to accidental bumps, and moreover not all the containers are provided with a handle configured to be hooked to the hook of the container holding element.

A second type of prior art container holder shelves are the ones made with bent, welded and painted steel wires, which are inexpensive, resistant to bumps and, in the case where the steel is stainless, resistant to chemical aggression by the concentrated chemicals. However, such shelves are bulky, whereby their storage takes up a lot of space, and they do not protect the containers (which are easily accessible) from undue uses and tampering; also, if the steel is not stainless, the metal is chemically etched and rusts with the concentrated chemicals fumes.

A third type of prior art container holder shelves are the closable ones made of plastics, which are inexpensive, resistant to chemical aggression and protecting containers from undue uses and tampering. However, such shelves are bulky, whereby their storage takes up a lot of space, and moreover they are often not much robust and, consequently, not much resistant to bumps.

Finally, all the prior art container holder shelves suffer from the drawback to be not easily adaptable to the spaces where they must be installed, consequently rendering installation complex and expensive.

Therefore, it is an object of the present invention to allow storage of liquid containers, such as for instance containers containing concentrated chemicals for cleaning surfaces, and more generally objects, in a simple, reliable, efficient, versatile and inexpensive way, protecting the containers (and more generally objects) from possible tampering, also simplifying the operations of transportation, assembling, installation and maintenance, while reducing at the same time its costs.

It is specific subject matter of the present invention a foldable shelf for storing objects, in particular for storing liquid containers, comprising a bracket configured to be attached to a wall and a foldable box including a supporting frame comprising two ledges, which are parallel to each other and integrally connected to each other through two connecting bars, wherein the foldable box further comprises a pair of first walls and a pair of second walls, each one of the first walls being hinged along a first edge to a respective bar of the two connecting bars, whereby each one of the first walls is configured to assume an angular position ranging from a first limit angular position, wherein a second edge of the first wall opposite to the first edge is at a minimum distance from the two ledges, to a second limit angular position, wherein the second edge is at a maximum distance from the two ledges, each one of the second walls being hinged along a first edge to a respective ledge out of the two ledges, whereby each one of the second walls is configured to assume an angular position ranging from a first limit angular position, wherein a second edge of the second wall opposite to the first edge is at a minimum distance from the two connecting bars, to a second limit angular position, wherein the second edge is at a maximum distance from the two connecting bars, where the foldable box is configured to assume a fully folded configuration, wherein the first and second walls are at the respective first limit angular positions, and an operative configuration, wherein the first and second walls are at the respective second limit angular positions, wherein the first and second walls are respectively provided with first and second mechanical stabilising elements configured to mutually interact with each other to cause the first and second walls to stably maintain their respective second limit angular positions, a first pair of walls selected out of the pair of first walls and the pair of second walls being provided with projecting elements configured to slide, when the foldable box assumes its operative configuration, in corresponding slots of the bracket along a coupling linear direction until they reach a lock position wherein the foldable box is stably attached to the bracket and the foldable shelf assumes an operative configuration, wherein the bracket is provided with elastic locking elements configured to interact with the other pair of walls selected out of the pair of first walls and the pair of second walls to cause the foldable shelf to stably assume its operative configuration.

According to another aspect of the invention, the supporting frame may be provided with at least one door hinged to one out of the two connecting bars or to one out of the two ledges, said at least one door being configured to assume a closed configuration wherein the foldable shelf, when it assumes its operative configuration, is closed.

According to a further aspect of the invention, said at least one door may be provided with a lock configured to lock said at least one door in its closed configuration.

According to an additional aspect of the invention, said at least one door may be provided with a transparent panel.

According to another aspect of the invention, when the foldable shelf assumes an operative configuration and is closed, at least part of the first and second mechanical stabilising elements and at least part of the elastic locking elements may be inaccessible from outside.

According to a further aspect of the invention, the first pair of walls may consist of the pair of first walls and the other pair of walls may consist of the pair of second walls.

According to an additional aspect of the invention, said first mechanical stabilising elements may comprise:

one or more, optionally two or more, teeth with which each one of the first walls is provided in proximity of each one of two angles opposite to the first edge of the respective first wall, said one or more teeth being directed towards the inside of the foldable shelf when the latter assumes its operative configuration and configured to elastically bend towards the outside of the supporting frame of the foldable box, and a plurality of alignment pins with which each one of the first walls is provided along two respective third edges, joining the first and second edges of the respective first wall, wherein the alignment pins are directed towards the inside of the foldable shelf when the latter assumes its operative configuration, and said second mechanical stabilising elements may comprise:

a plurality of slots with which each one of the second walls is provided along two respective third edges, joining the first and second edge of the respective second wall, wherein, when the foldable box assumes the operative configuration, the two third edges of each one of the first walls are configured to come into contact with corresponding third edges of the pair of second walls so that the respective alignment pins insert into corresponding slots of the two corresponding third edges of the second walls, and said one or more teeth with which each one of the first walls is provided are configured to assume a rest position at which they interact with the corresponding third edges, whereby said one or more teeth are configured to lock the second walls in the respective second limit angular positions.

According to another aspect of the invention, said projecting elements may be positioned in correspondence with the second edges of each one of the second walls, and each one of the corresponding slots of the bracket may comprise a receiving portion and a locking portion, wherein the receiving portion has a width larger than a width of the locking portion, each one of the projecting elements having a planar end, having a width larger than the width of the locking portion, that is configured to insert into the receiving portion and to cause the projecting element to slide from the receiving portion to the locking portion, where the planar end is configured to interact with the locking portion to cause the projecting element to be stably locked into the corresponding slot.

According to a further aspect of the invention, said elastic locking elements may comprise at least one pair of teeth positioned along each one of two edges of the bracket configured to come into contact with the second walls when the foldable shelf assumes its operative configuration, wherein said at least one pair of teeth are directed towards the inside of the foldable shelf when the latter assumes its operative configuration, said at least one pair of teeth being configured to elastically bend towards the outside of the foldable shelf when the latter assumes its operative configuration, wherein said at least one pair of teeth are configured to assume a rest position at which they interact with the second walls, whereby said at least one pair of teeth are configured to prevent the second walls from mutually sliding with respect to the bracket along the coupling linear direction and a direction opposite to the coupling linear direction when the foldable shelf assumes its operative configuration.

According to an additional aspect of the invention, the second walls may be provided with ribs having projecting ends which project from the second edges of the second walls, the projecting ends of the ribs of one out of the second walls being configured to insert into corresponding edge notches of the bracket, and the projecting ends of the ribs of the other one out of the second walls being configured to insert and slide in corresponding linear slots of the bracket until getting into contact with ends of the corresponding linear slots, whereby the corresponding edge notches and the ends of the corresponding linear slots of the bracket are configured to prevent the projecting ends of the ribs of the second walls from sliding with respect to the bracket along the coupling linear direction when the foldable shelf assumes its own operative configuration.

According to another aspect of the invention, one or more walls out of the first walls and the second walls may be provided with one or more removable portions delimited by cut-out lines.

According to a further aspect of the invention, the bracket may be provided with:

one or more projecting sliders, and one or more projecting hollow guides, wherein said one or more projecting sliders and said one or more projecting hollow guides are arranged along at least two edges of the bracket opposite to each other, each projecting slider being configured to insert into a hollow guide identical to one of said one or more projecting hollow guides until reaching a stop position, whereby the bracket is configured to be mounted in a modular way to one or more external brackets provided with at least one slider identical to one of said one or more projecting sliders and/or with at least one hollow guide identical to one of said one or more projecting hollow guides.

According to an additional aspect of the invention, the foldable shelf may further comprise at least one stroke limiting element configured to be mounted onto one of said one or more projecting hollow guides and to limit a stroke of a slider identical to one of said one or more projecting sliders.

According to another aspect of the invention, the bracket may be provided with:

one or more projecting discs, and one or more projecting gripper elements, wherein said one or more projecting discs and said one or more projecting gripper elements are arranged along at least two edges of the bracket opposite to each other, each projecting gripper element being configured to receive and lock a disc identical to one of said one or more projecting discs, whereby the bracket is configured to be mounted in a modular way to one or more external brackets provided with at least one disc identical to one of said one or more projecting discs and/or with at least one gripper element identical to one of said one or more projecting gripper elements, wherein said one or more projecting discs are optionally positioned in corresponding edge recesses of the bracket.

According to a further aspect of the invention, at least one out of the bracket and the foldable box may be made of plastic material.

The advantages offered by the foldable shelf according to the invention are evident.

First of all, it allows to be stored and easily transported, since in the fully folded configuration it has an extremely limited size.

Also, the foldable shelf according to the invention is simple to install and optionally allows to make shelf structures which are versatile and easily adaptable to the available specific spaces. In fact, its bracket for attachment to wall may have such a shape to render it modular, whereby it may be also mounted along with other shelves or devices (e.g. a diluter of concentrated chemical in water or a dosing pump) having similar brackets for attachment to wall carrying out multiple customisable combinations and configurations.

Once installed in the operative configuration and closed, the foldable shelf according to the invention further ensures in a reliable and efficient way support and, where provided with lock, protection of the liquid containers (and more generally of the objects) contained therein from possible tampering and unauthorised accesses.

Furthermore, the foldable shelf according to the invention, that is made (at least partially) of plastic material, is durable, since it is resistant to the action of concentrated chemicals (i.e. it does not oxidise).

Moreover, the foldable shelf according to the invention is inexpensive and it can be made according to a design with smooth surfaces rendering the same easy to clean.

The present invention will be now described, by way of illustration and not by way of limitation, according to its preferred embodiments, by particularly referring to the Figures of the annexed drawings, in which:

FIG. 1 shows a first front perspective view of a preferred embodiment of the foldable shelf according to the invention in an open operative configuration;

Figure 3:
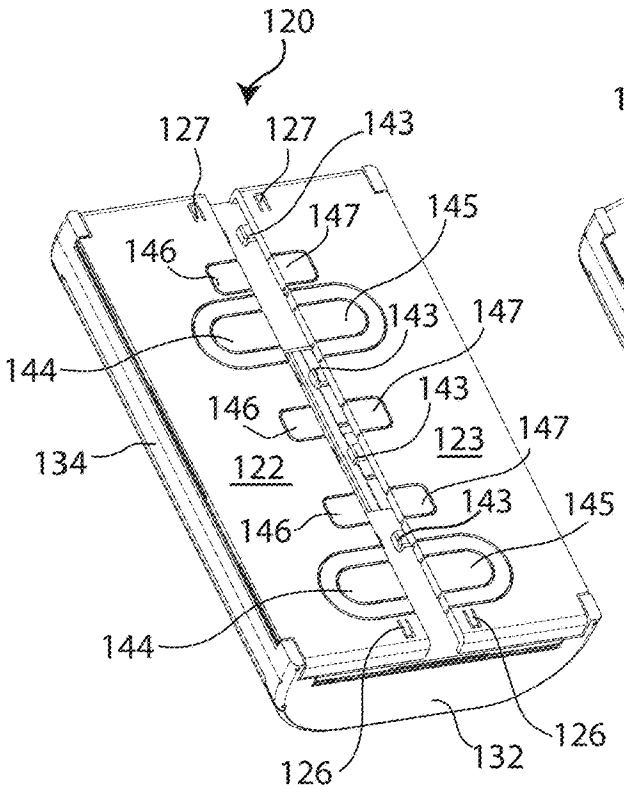
FIG. 3 shows a rear perspective view of the foldable box of the foldable shelf of FIG. 1 in a fully folded configuration.
Figure 7:
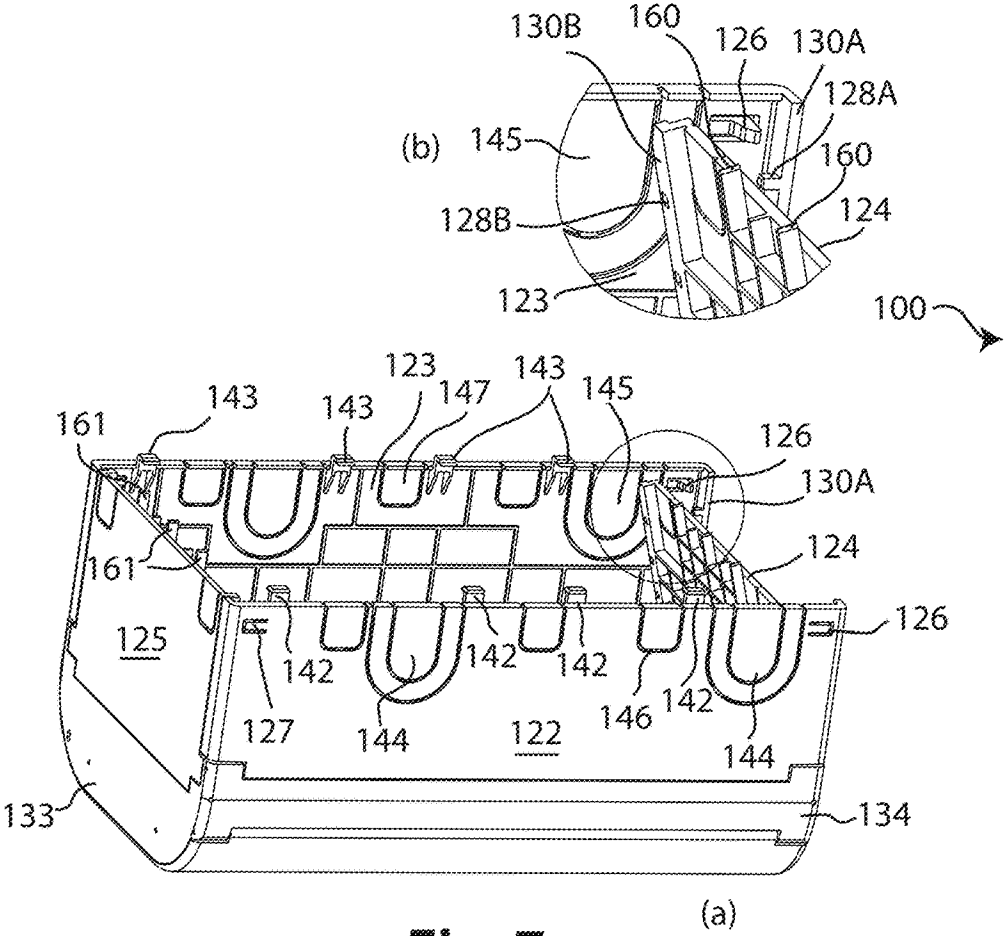

FIG. 7*a* shows a rear perspective view of the foldable box of FIG. 3 in a fourth intermediate configuration between the fully folded configuration and the operative configuration, and FIG. 7*b* shows a particular of FIG. 7*a;*

FIG. 8*a* shows a rear perspective view of the foldable box of FIG. 3 in the operative configuration, and FIG. 8*b* shows a particular of FIG. 8*a;*

Figure 2:
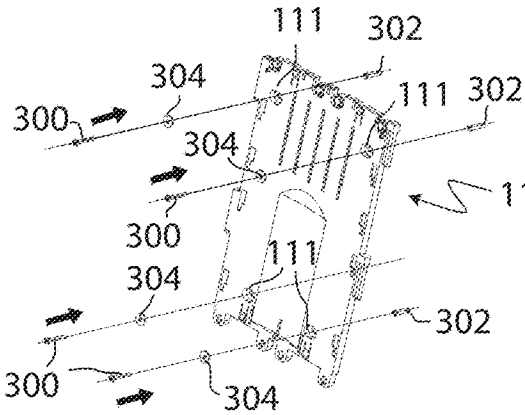
FIG. 2 shows a front perspective view of the bracket of the foldable shelf of FIG. 1.

FIG. 9*a* shows a first front perspective view of a first step of coupling of the bracket of FIG. 2 to the foldable box of FIG. 8*a*, FIG. 9*b* shows a front perspective view of a second step of coupling of the bracket of FIG. 2 to the foldable box of FIG. 8*a*, and FIG. 9*c* shows a rear perspective view of the second coupling step of FIG. 9*b;*

Figure 10A:
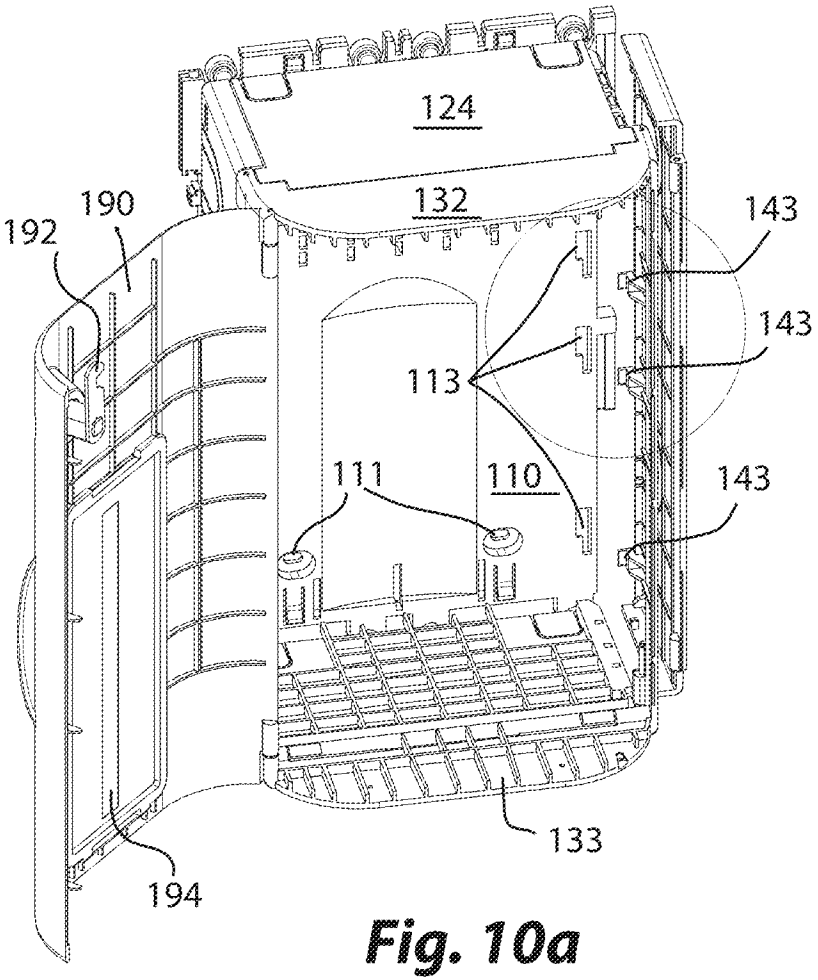
Figure 10B:
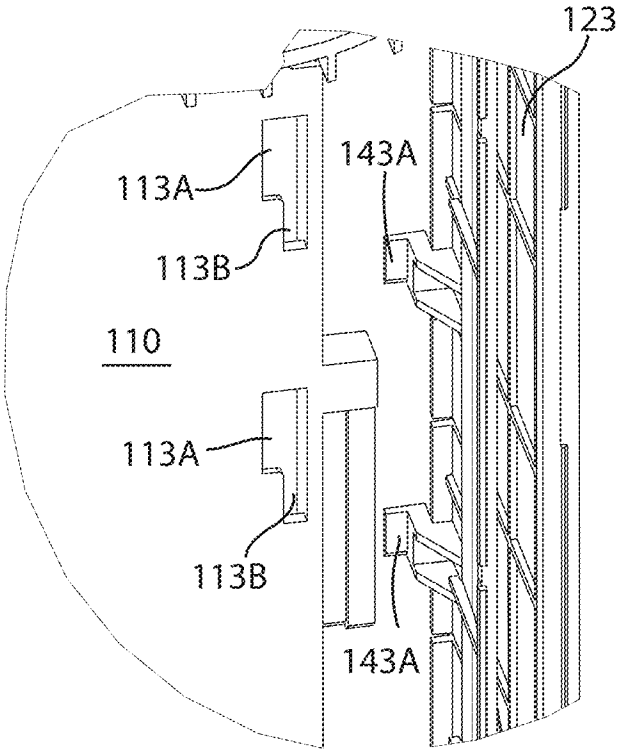

FIG. 10*a* shows a partially exploded front perspective view of the foldable shelf of FIG. 1 in an open operative configuration, and FIG. 10*b* shows a particular of FIG. 10*a;*

FIG. 11*a* shows a partially exploded rear perspective view of the foldable shelf of FIG. 1 in an open operative configuration, and FIG. 11*b* shows a particular of FIG. 11*a;*

Figure 13:
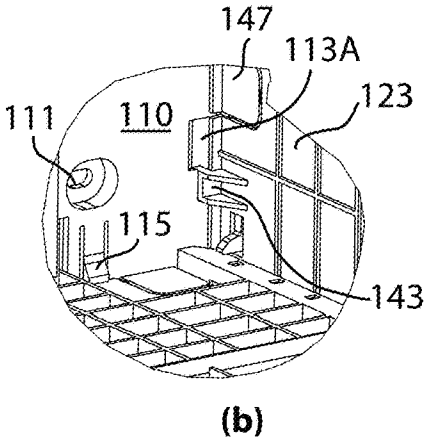
Figure 12:
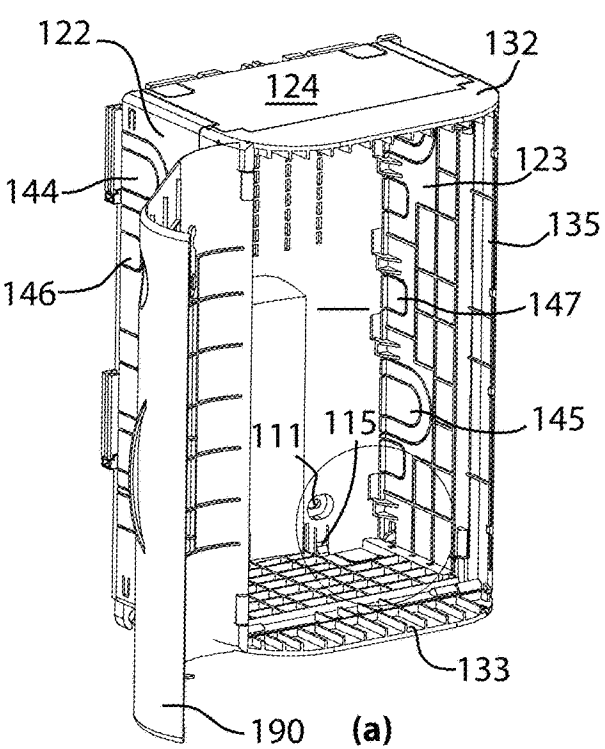
Figure 12:
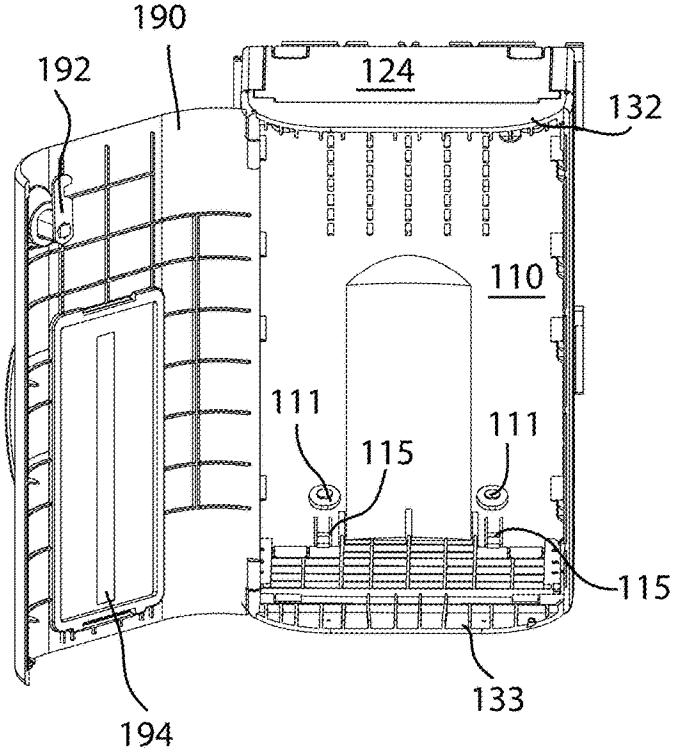

FIG. 12 shows a second front perspective view of the foldable shelf of FIG. 1 in an open operative configuration;

FIG. 13*a* shows a third front perspective view of the foldable shelf of FIG. 1 in an open operative configuration, and FIG. 13*b* shows a particular of FIG. 13*a;*

Figure 15:
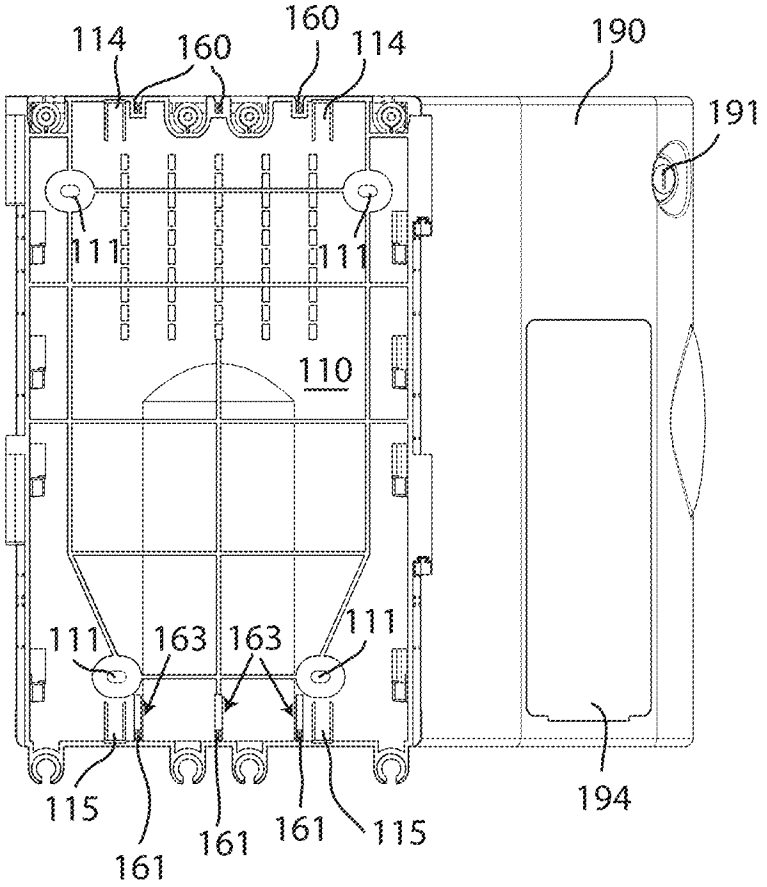
Figure 14:
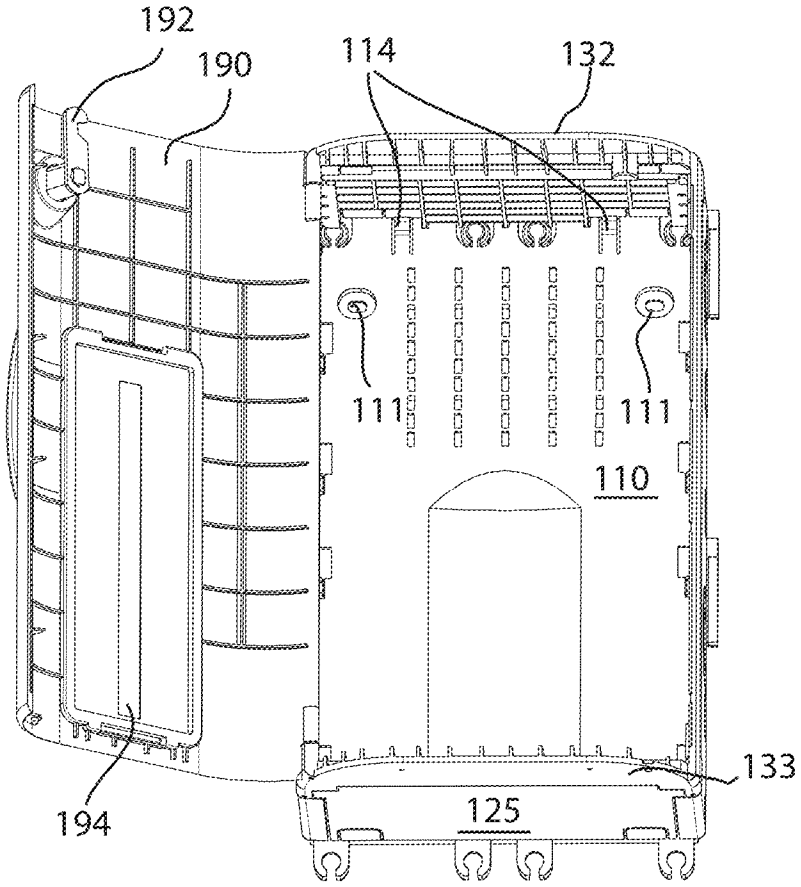

FIG. 14 shows a fourth front perspective view of the foldable shelf of FIG. 1 in an open operative configuration;

FIG. 15 shows a rear view of the foldable shelf of FIG. 1 in an open operative configuration;

FIG. 16*a* shows a front perspective view of three brackets identical to the bracket of FIG. 2 in a first step of mutual coupling, and FIG. 16*b* shows a particular of FIG. 16*a;*

FIG. 17*a* shows a front perspective view of the three brackets of FIG. 16*a* when mutually coupled, and FIG. 17*b* shows a particular of FIG. 17*a;*

FIG. 18*a* shows a front perspective view of three brackets identical to the bracket of FIG. 2 in a second step of mutual coupling, and FIG. 18*b* shows the three brackets of FIG. 18*a* when mutually coupled;

FIG. 19*a* shows a front perspective view of the bracket of FIG. 2 in a step of mounting two stroke limiting elements, FIG. 19*b* shows a perspective view of a stroke limiting element, FIG. 19*c* shows a front perspective view of the bracket of FIG. 2 on which two stroke limiting elements are mounted, FIG. 19*d* shows a particular of FIG. 19*c*, FIG. 19*e* shows a front view of the bracket of FIG. 19*c* coupled to a first external bracket according to a first configuration, FIG. 19*f* shows a front view of the bracket of FIG. 19*c* coupled to the first external bracket according to a second configuration, FIG. 19*g* shows a front view of the bracket of FIG. 19*c* coupled to the first external bracket according to a third configuration, and FIG. 19*h* shows a particular of FIG. 19*e;*

Figure 20C:
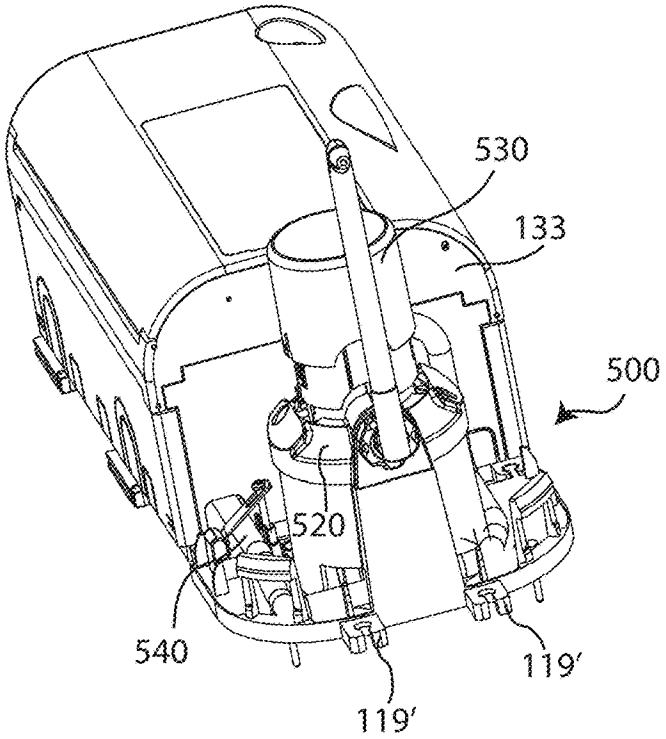

FIG. 20*a* shows a front view of a first assembly of the foldable shelf of FIG. 1 in a closed operative configuration coupled to an external dispensing apparatus, FIG. 20*b* shows a front view of the first assembly of FIG. 20*b* wherein a cover of the external dispensing apparatus has been removed, and FIG. 20*c* shows a front perspective view of the first assembly of FIG. 20*b*; and FIG. 21*a* shows a front perspective view of a second assembly of the foldable shelf of FIG. 1 in the open operative configuration coupled to an external diluting apparatus, FIG. 21*b* shows a front perspective view of the second assembly of FIG. 21*a* wherein the foldable shelf is in the closed operative configuration, FIG. 21*c* shows a front perspective view of a third assembly of the foldable shelf of FIG. 1 in the closed operative configuration coupled to an external diluting apparatus, and FIG. 21*d* shows a front perspective view of a fourth assembly comprising four foldable shelves identical to the one of FIG. 1 in the closed operative configuration coupled to each other and to an external diluting apparatus.

In the Figures, identical reference numerals will be used for alike elements.

In the following of the description, directional terminology, such as "right", "left", "front", "rear", "base", "top", "upper", "lower", "side", etc., is used with reference to the Figures of the attached drawings. Since components and/or elements and/or embodiments of the present invention may be positioned and/or caused to operate in various different orientations, directional terminology is merely used by way of example and not by way of limitation.

With reference to FIG. 1, a preferred embodiment of the foldable shelf 100 according to the invention in an open operative configuration (and attached to a wall, not shown) may be observed, wherein the front door 190 is open and the inside of the foldable shelf 100 is accessible; in particular, a container 200 containing concentrated chemicals is shown inside the foldable shelf 100.

In particular, the foldable shelf 100 comprises a bracket 110, that is substantially planar and is configured to be attached to a wall, shown in FIG. 2, and a foldable box 120, that is shown in FIG. 3 in the fully folded configuration. Advantageously, one or both of the bracket 110 and the foldable box 120 are made of plastic material.

The foldable box 120 includes a supporting frame comprising two ledges 132 and 133 parallel to each other and integrally connected to each other through two connecting bars 134 and 135, substantially orthogonal to the two ledges 132 and 133; optionally, the two connecting bars 134 and 135 are (at least partially) planar and (the respective planar portions) are parallel to each other.

As shown in FIGS. 2-8, the foldable box 120 comprises two side walls 122 and 123 and two end walls 124 and 125.

Each one of the two side walls 122 and 123 is hinged on a respective connecting bar, respectively 134 and 135, so that each side wall, 122 or 123, is configured to assume an angular position ranging from a first limit angular position (shown in FIG. 3) to a second limit angular position (shown in FIGS. 5-8): in the first limit angular position, the edge of the side wall, 122 or 123, opposite to the edge hinged on the respective connecting bar, 134 or 135, is at a minimum distance from the two ledges 132 and 133 (whereby the side wall, 122 or 123, is substantially arranged towards the inside of the supporting frame); in the second limit angular position, the edge of the side wall, 122 or 123, opposite to the edge hinged on the respective connecting bar, 134 or 135, is at a maximum distance from the two ledges 132 and 133 (whereby the side wall, 122 or 123, is substantially arranged towards the outside of the supporting frame), and optionally the side wall, 122 or 123, is arranged so as to be contiguous to the respective connecting bar, 134 or 135, and not to form sharp edges with the latter.

Each one of the two end walls 124 and 125 is hinged on a respective ledge, respectively 132 and 133, so that each end wall, 124 or 125, is configured to assume an angular position ranging from a first limit angular position (shown in FIGS. 3-5) to a second limit angular position (shown in FIG. 8): in the first limit angular position, the edge of the end wall, 124 or 125, opposite to the edge hinged on the respective ledge, 132 or 133, is at a minimum distance from the two connecting bars 134 and 135 (whereby the end wall, 124 or 125, is substantially arranged towards the inside of the supporting frame); in the second limit angular position, the edge of the end wall, 124 or 125, opposite to the edge hinged to the respective ledge, 132 or 133, is at a maximum distance from the two connecting bars 134 and 135 (whereby the end wall, 124 or 125, is substantially arranged towards the outside of the supporting frame), and optionally the end wall, 124 or 125, is arranged so as to be contiguous to the respective ledge, 132 or 133, and not to form sharp edges with the latter.

When the foldable box 120 assumes the fully folded configuration shown in FIG. 3, the foldable shelf 100 occupies a minimum space wherein it may be advantageously stored and transported. When the two side walls 122 and 123 and the two end walls 124 and 125 of the foldable box 120 are in the respective second limit angular positions, as shown in FIG. 8, the foldable box 120 is in the operative configuration (and the foldable shelf 100 may assume the corresponding operative configuration).

Figure 5:
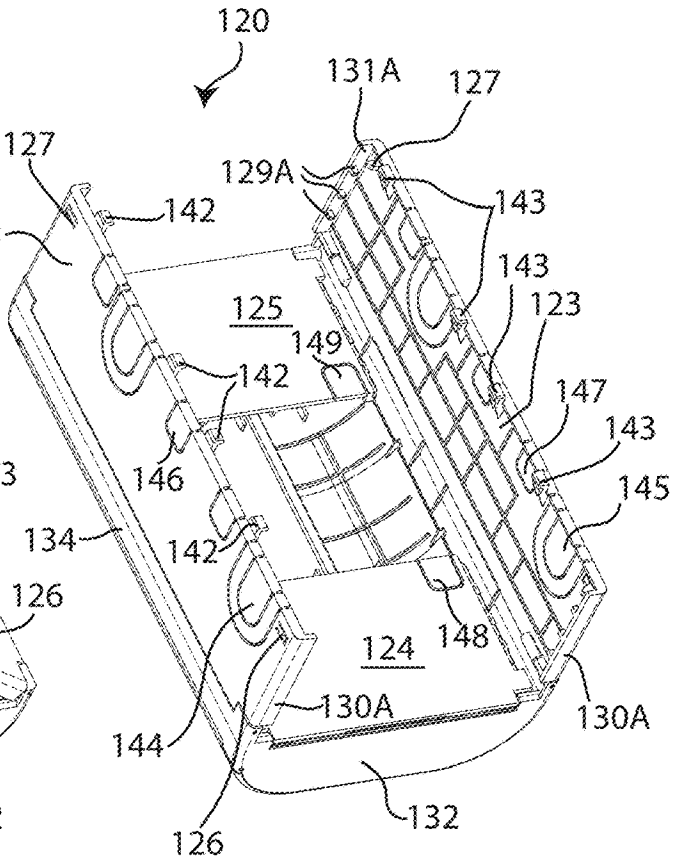
FIG. 5 shows a rear perspective view of the foldable box of FIG. 3 in a second intermediate configuration between the fully folded configuration and the operative configuration.
Figure 4:
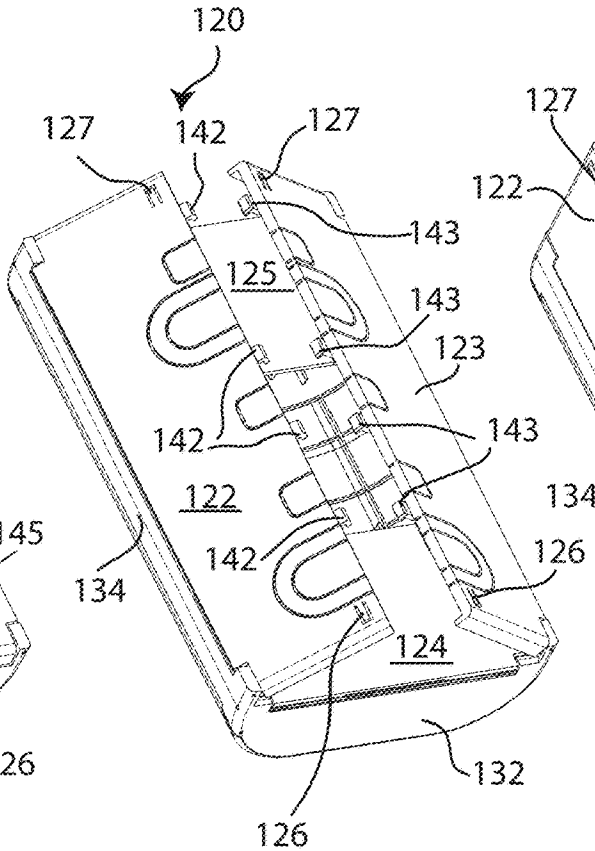
FIG. 4 shows a rear perspective view of the foldable box of FIG. 3 in a first intermediate configuration between the fully folded configuration and an operative configuration.
Figure 8:
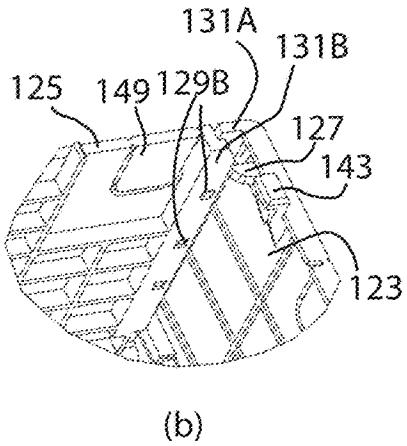
Figure 6:
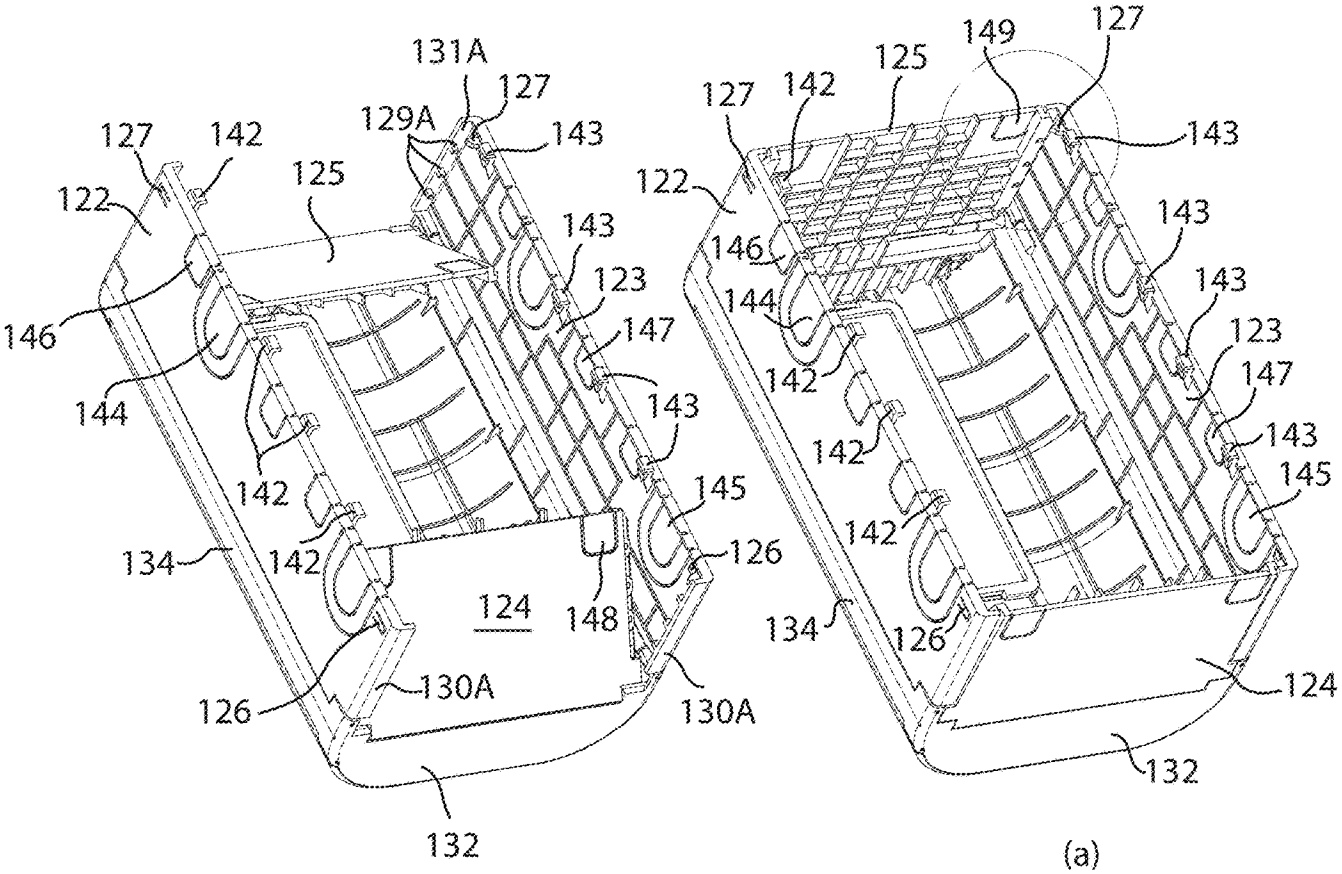
FIG. 6 shows a rear perspective view of the foldable box of FIG. 3 in a third intermediate configuration between the fully folded configuration and the operative configuration.

In order to make the foldable box 120 assume the operative configuration, starting from the fully folded configuration shown in FIG. 3, the two side walls 122 and 123 must first assume the respective second limit angular position, as shown in FIG. 5, and then the two end walls 124 and 125 must assume the respective second limit angular position, as shown in FIG. 8.

In particular, in the preferred embodiment shown in the Figures, the foldable shelf 100 is configured so that the two side walls 122 and 123 may assume the respective first limit angular position (shown in FIG. 3) only when the two end walls 124 and 125 assume the respective first limit angular position (shown in FIGS. 3-5), and the two end walls 124 and 125 may assume an angular position different from the respective first limit angular position only when the two side walls 122 and 123 assume the respective second limit angular position (shown in FIGS. 5-8).

In the preferred embodiment of the foldable shelf 100 shown in the Figures, the two side walls 122 and 123 and the two end walls 124 and 125 of the foldable box 120 stably maintain the respective second limit angular positions, as shown in FIG. 8, thanks to mutually interacting mechanical stabilising elements with which the two side walls 122 and 123 and the two end walls 124 and 125 are provided. In particular, each one of the two side walls 122 and 123 is provided, in proximity of each one of the two angles opposite to the edge hinged on the respective connecting bar, 134 or 135, with two teeth 126 and 127 directed towards the inside of the supporting frame (i.e. directed towards the inside of the foldable shelf 100 when the latter assumes its own operative configuration) and configured to elastically bend towards the outside of the supporting frame. Also, each one of the two side walls 122 and 123 is provided, on the edges 130A and 131A configured to come into contact with corresponding edges 130B and 131B of the two end walls

124 and 125, respectively, when la foldable box 120 assumes the operative configuration, with alignment pins 128A and 129A directed towards the inside of the supporting frame (i.e. directed towards the inside of the foldable shelf 100 when the latter assumes its own operative configuration) and configured to insert into corresponding slots, respectively 128B and 129B, with which the edges 130B and 131B of the two end walls 124 and 125 are provided. As shown in FIGS. 7*b* and 8*b*, when the two side walls 122 and 123 assume their respective second limit angular position and the two end walls 124 and 125 rotate starting from their respective first limit angular position, the two end walls 124 and 125 come into contact with the teeth 126 and 127, which elastically outwards bend during the passage of the two end walls 124 and 125, until they stably assume their respective second limit angular position wherein the alignment pins 128A and 129A of the edges 130A and 131A are inserted into the slots, respectively 128B and 129B, of the edges 130B and 131B and the teeth 126 and 127, returned to the rest position, interact with the edges 130B and 131B thus locking the two end walls 124 and 125 in their respective second limit angular position.

In this regard, it must be understood that other embodiments of the foldable shelf according to the invention may be differently configured, for instance in such a way that the two end walls may assume their respective first limit angular position only when the two side walls assume their respective first limit angular position and the two side walls may assume an angular position different from the respective first limit angular position only when the two end walls assume their respective second limit angular position. Also, further embodiments of the foldable shelf according to the invention may have, alternatively to or in combination with the presence of elastically flexible teeth on the two side walls 122 and 123, similar elastically flexible teeth present on the two end walls 124 and 125 configured to interact with the two side walls 122 and 123. Furthermore, other embodiments of the foldable shelf according to the invention may be deprived of mechanical alignment elements or provided with mechanical alignment elements different from the alignment pins 128A and 129A and corresponding slots 128B and 129B.

Installation of the foldable shelf 100 is carried out by attaching the bracket 110 to a wall through conventional attachment elements inserted into through holes 111 with which the bracket 110 is provided, for instance through screws 300, provided with washers 304, inserted into the through holes 111 and into wall plugs 302, as shown in FIG. 2.

Then, the foldable box 120 in the operative configuration of FIG. 8 is attached to the bracket 110 by making projecting elements with which the side walls 122 and 123 are provided slide, along a coupling linear direction, in corresponding properly shaped slots of the bracket 110 until they reach a lock position at which the foldable box 120 is stably attached to the bracket 110, as it is illustrated in detail later.

Figure 9:
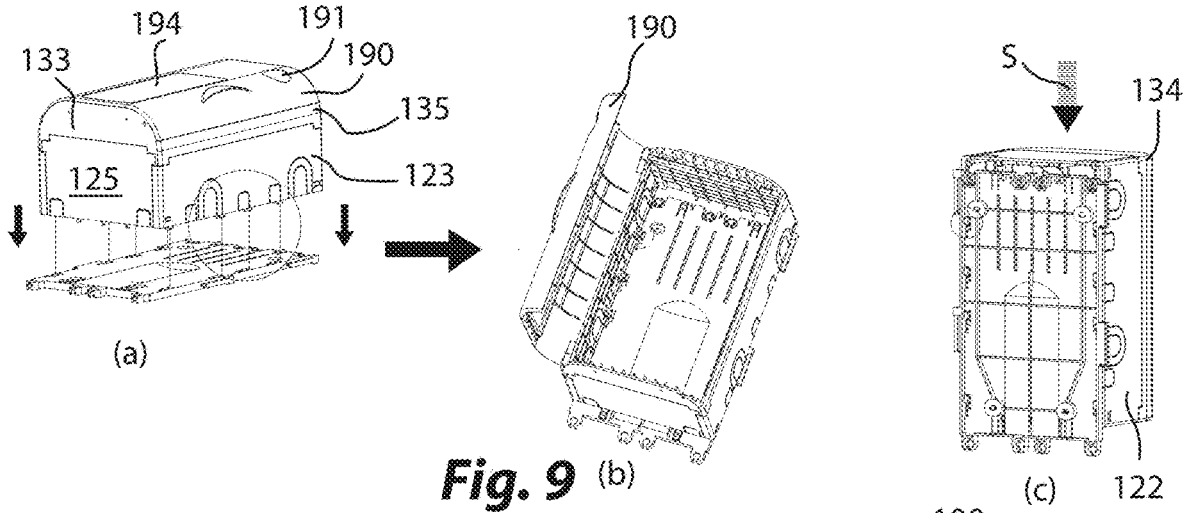
Figure 11:
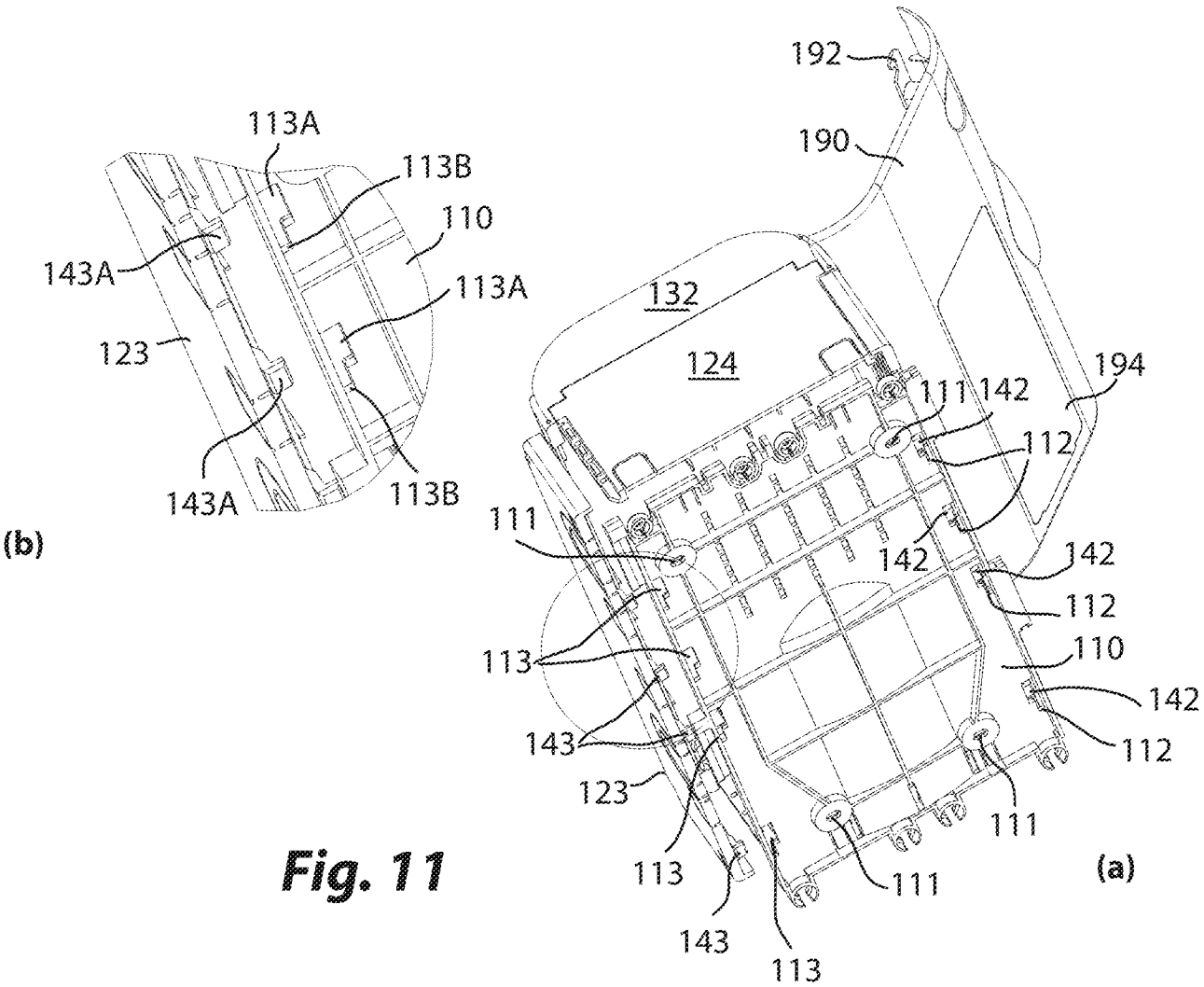

With reference to FIGS. 9-11, the side walls 122 and 123 are provided with projecting elements 142 and 143, respectively, in correspondence of the edges opposite to the edges hinged on the respective connecting bars 134 and 135 (optionally four ones for each edge), and the bracket 110 is provided with properly shaped slots 112 and 113, each one having a receiving portion with a width larger than the width of a locking portion, in correspondence of the edges coming into contact with the side walls 122 and 123, respectively, when the foldable shelf assumes its operative configuration. As particularly shown in FIGS. 10*b* and 11*b* for the projecting elements 143 and the slots 113, the former are shaped so as to have a planar end 143A configured to insert into the receiving portion 113A (where the planar end of the projecting elements 142 and 143 has a width equal or, preferably, slightly lower than the width of the receiving portion of the properly shaped slots 112 and 113), so that the projecting elements 142 and 143 slide from the receiving portion 113A to the locking portion 113B, where the interaction of the planar end 143A with the latter locks the projecting elements 142 and 143 in the properly shaped slots 112 and 113 (since the planar end of the projecting elements 142 and 143 has a width larger than the width of the locking portion of the properly shaped slots 112 and 113). Insertion of the projecting elements 142 and 143 into the properly shaped slots 112 and 113 is schematically illustrated in FIG. 9, where the arrow S of FIG. 9*c* indicates the coupling linear direction along which the former slide in the latter: such direction is convenient because it is concordant with the direction of the weight force acting on the foldable box 120, whereby it increases stability of the foldable shelf 100 in the operative configuration; in particular, in the operative configuration the bracket 110 operates as a cover closing the foldable box 120, and the two end walls 124 and 125 and the two side walls 122 and 123 are advantageously orthogonally coupled to the bracket 110.

It must be understood that other embodiments of the foldable shelf according to the invention may have a coupling linear direction, along which the projecting elements slide in the properly shaped slots, that is opposite to the one illustrated in FIGS. 9-11 (and in such case the positions of the receiving portion and of the locking portion of each properly shaped slot are reversed with respect to those illustrated in FIGS. 9-11).

The bracket 110 is also provided with elastic locking elements interacting with the two end walls 124 and 125 so as to make the foldable shelf 100 stably assume its operative configuration. In particular, as shown in detail in FIGS. 12-15, the bracket 110 is provided, in proximity of each one of the two edges coming into in contact with the two end walls 124 and 125, with respective two teeth 114 and 115 directed towards the inside of the foldable box 120 (when the latter is coupled to the bracket 110, i.e. directed in direction opposite to the wall to which the bracket 110 is attached, whereby the two teeth 114 and 115 are directed towards the inside of the foldable shelf 100 when the latter assumes its own operative configuration) configured to elastically bend towards the outside of the foldable box 120 (when the latter is coupled to the bracket 110, i.e. towards the wall to which the bracket 110 is attached). As shown in detail in FIGS. 12-14, when the projecting elements 142 and 143 insert and slide in the properly shaped slots 112 and 113 along the coupling linear direction indicated by the arrow S of FIG. 9*c*, i.e. when the foldable box 120 slides on the bracket 110, the end wall 125 comes into contact with the teeth 115, which elastically outwards bend during the passage of the end wall 125 allowing the latter to pass them until it stably assumes its own second angular position corresponding to the operative configuration of the foldable shelf 100, wherein the teeth 114 lock the end wall 124 and consequently avoid any further sliding of the foldable box 120 on the bracket 110 along the coupling linear direction indicated by the arrow S of FIG. 9*c*, while the teeth 115 lock the end wall 125 and consequently avoid any reverse sliding of the foldable box 120 on the bracket 110 along the sliding direction opposite to the coupling linear direction indicated by the arrow S of FIG. 9*c*. Consequently, the foldable shelf 100 stably assumes its operative configuration.

In this regard, the end walls 124 and 125 are advantageously provided with auxiliary locking projecting elements (which may be missing in other embodiments of the foldable box according to the invention), which interacts with corresponding linear edge slots and notches of the bracket 110, which contribute to make the foldable box 120 stably assume its operative configuration of FIG. 8 limiting the sliding along the bracket 110. In fact, as particularly shown in FIGS. 7*a*, 15 and 16, the end walls 124 and 125 are provided with internal ribs 160 and 161, respectively, the ends of which protrude from the edge of the end wall, 124 or 125, opposite to the edge hinged on the respective ledge, 132 or 133. The projecting ends of the stiffening internal ribs 160 of the end wall 124 are configured to insert into corresponding notches 162 of the bracket 110 positioned along the edge of the latter coming into contact with the end wall 124; the projecting ends of the stiffening internal ribs 161 of the end wall 125 are configured to insert and slide in corresponding linear slots 163 of the bracket 110 positioned in proximity of the edge of the latter coming into contact with the end wall 125, allowing the foldable box 120 to slide on the bracket 110. The interaction of the projecting ends of the stiffening internal ribs 160 of the end wall 124 with the corresponding notches 162 of the bracket 110 and the interaction of the projecting ends of the stiffening internal ribs 161 of the end wall 125 with the end edges of the corresponding linear slots 163 of the bracket 110 contribute to stably maintain the foldable shelf 100 in its operative configuration, limiting its sliding along the direction indicated by the arrow S of FIG. 9*c*.

It must be understood that for the other embodiments of the foldable shelf according to the invention which have a coupling linear direction along which projecting elements slide in properly shaped slots opposite to the one illustrated in FIGS. 9-11, the positions of the notches and linear slots of the bracket 110 are reversed, whereby linear slots (similar to those indicated with numeral 163 for the preferred embodiment) are positioned in proximity of the edge of the bracket 110 coming into contact with the end wall 124, and notches (similar to those indicated with numeral 162 for the preferred embodiment) are positioned along the edge of the bracket 110 coming into contact with the end wall 125.

In particular, as shown in the Figures, when the preferred embodiment of the foldable shelf 100 assumes its operative configuration, the bracket 110 is positioned at the back (attached to the wall), the end wall 124 is at the top, the end wall 125 is at the bottom, the side wall 122 is positioned at the left and the side wall 123 is positioned at the right.

Other embodiments of the foldable shelf according to the invention may have the end walls 124 and 125, instead of the side walls 122 and 123, which are provided with projecting elements (similar to those indicated with reference numerals 142 and 143 for the preferred embodiment) in correspondence of the edges opposite to the edges hinged on the respective ledges 132 and 133. In this case, the bracket 110 is provided with properly shaped slots (similar to those indicated with reference numerals 112 and 113 for the preferred embodiment) which are positioned along the edges coming into contact with the end walls 124 and 125, so as to allow such projecting elements to insert and slide in the properly shaped slots until they lock, according to a coupling linear direction orthogonal to the one indicated by the arrow S of FIG. 9*c*; also, the bracket 110 is provided, in proximity of each one of the two edges coming into contact with the two side walls 122 and 123, instead of the end walls 124 and 125, with respective teeth (similar to those indicated with reference numerals 114 and 115 for the preferred embodiment), allowing the foldable shelf 100 to stably assume its operative configuration. Possibly, in such other embodiments of the foldable shelf according to the invention, the two side walls 122 and 123, instead of the end walls 124 and 125, are provided with internal ribs (similar to those indicated with reference numerals 160 and 161 for the preferred embodiment), wherein the projecting ends of the ribs of one of the two side walls 122 and 123 are configured to insert into corresponding notches (similar to those indicated with reference numerals 162 for the preferred embodiment) of the bracket 110 positioned along the edge of the latter coming into contact with such side wall, while the projecting ends of the ribs of the other one of the two side walls 122 and 123 are configured to insert and slide in corresponding linear slots (similar to the one indicated with reference numeral 163 for the preferred embodiment) of the bracket 110 positioned in proximity of the edge of the latter coming into contact with such other side wall, allowing the foldable box 120 to slide on the bracket 110, so that the interaction of the projecting ends of the stiffening internal ribs of the two side walls with the corresponding end notches and edges of the corresponding linear slots of the bracket 110 contribute to stably maintain the foldable shelf 100 in its operative configuration.

As stated, the foldable box 120 is provided with a front door 190, hinged on the connecting bar 134 (although this is not an essential feature for the invention, and other embodiments of the foldable shelf may have a door hinged on the other connecting bar 135, or two doors each one hinged on one of the two connecting bars 134 and 135 of the supporting frame of the foldable box, or even one door hinged on one of the two ledges 132 and 133 of the supporting frame of the foldable box or two doors respectively hinged on the two ledges 132 and 133, whereby the foldable shelf according to the invention may be provided with one or more doors, each one hinged on one of the two connecting bars 134 and 135 or on one of the two ledges 132 and 133 of the supporting frame). The front door 190 is closable through a lock 191 with lever 192 operated through a key (that can be a master key or specific for the pawl of the lock 191). Also, the front door 190 has a transparent panel 194 permitting to visually check the container 200 and the liquid contained therein (or in any case the inside of the foldable shelf 100).

In this regard, once that the foldable box 120 is mounted on the bracket 110, whereby the foldable shelf 100 stably assumes its operative configuration, all the elastic locking elements, i.e. all the elastically flexible teeth 114, 115, 126 and 127, ensuring maintenance of the foldable shelf 100 in its operative configuration, remain inside the same foldable shelf 100 and they are not accessible from the outside when the front door 190 is closed, whereby the foldable shelf 100 is not dismountable from the outside.

Figure 16:
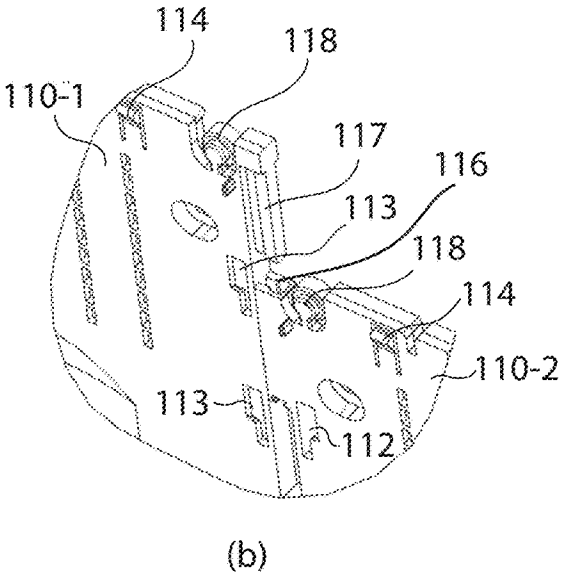
Figure 16:
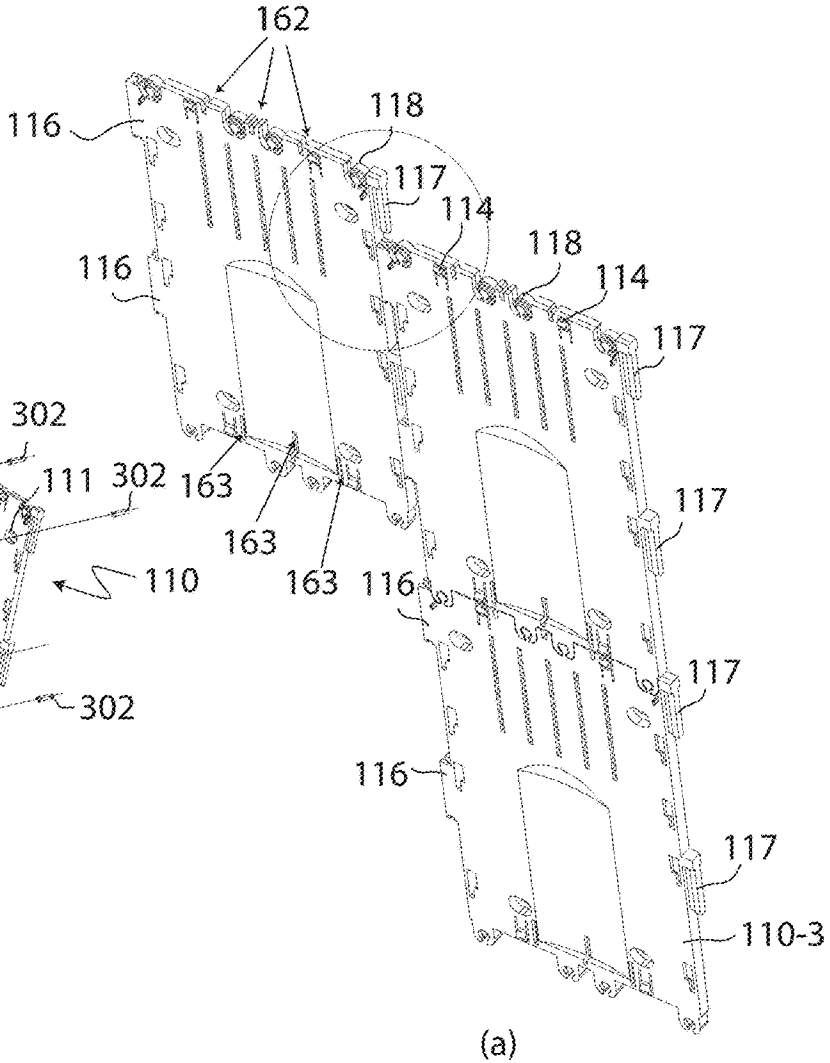
Figure 17:
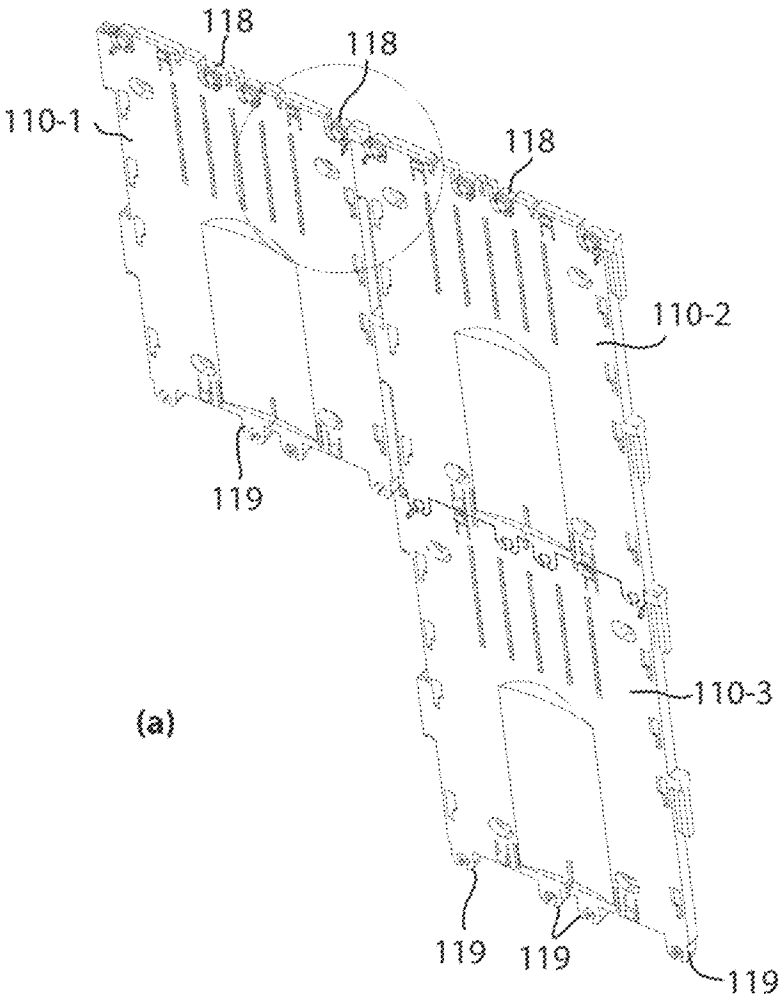
Figure 17:
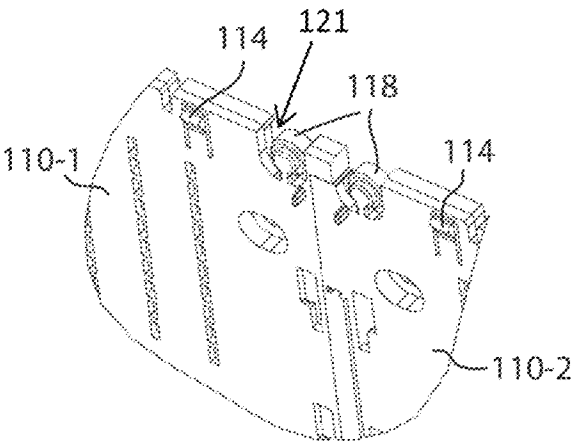
Figure 18:
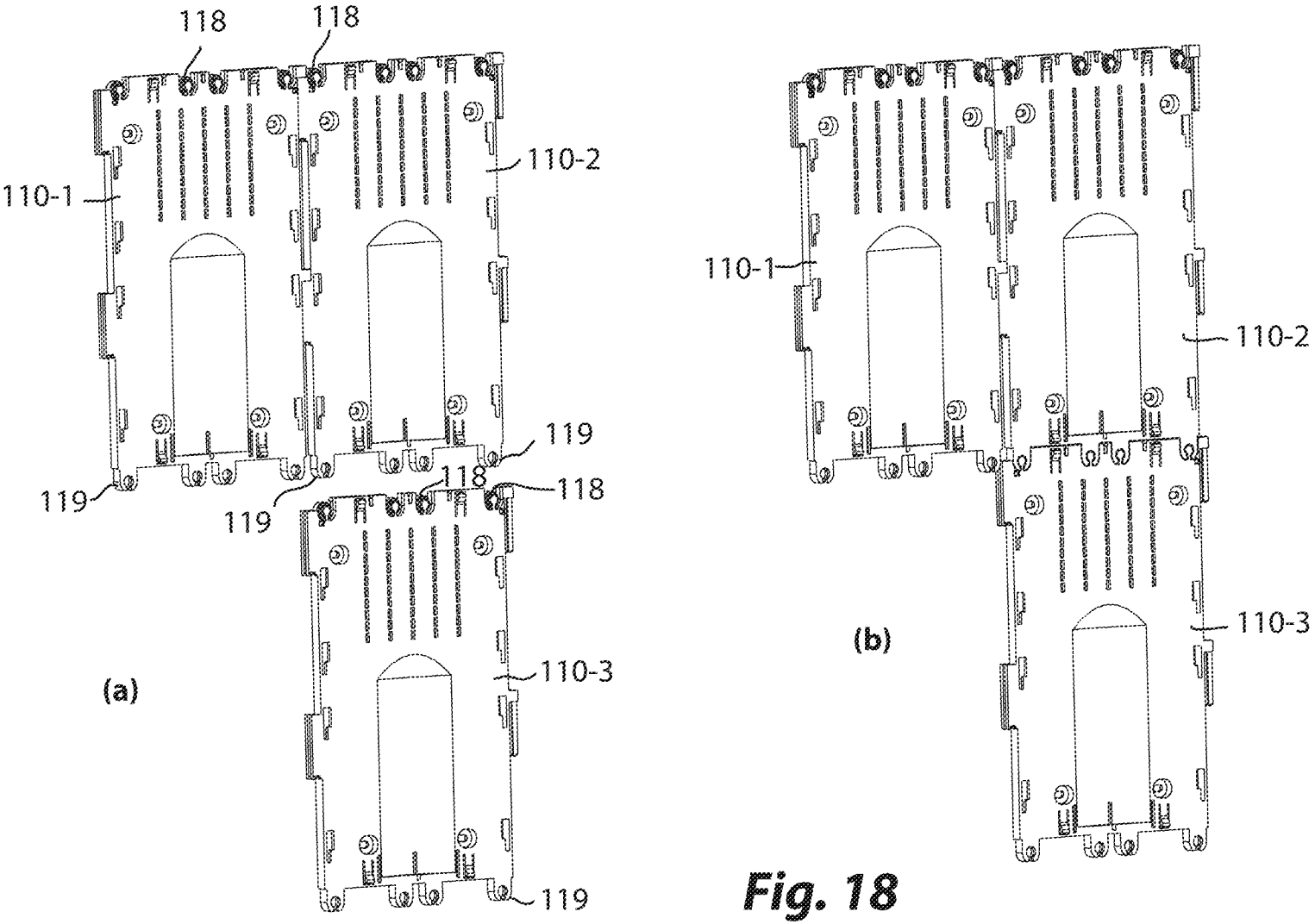

In the preferred embodiment of the foldable shelf according to the invention, the shape of the bracket 110 renders the foldable shelf 100 modular, whereby the latter can be mounted along with other foldable shelves of the same type or devices (e.g. a diluter of concentrated chemical in water or a dosing pump) having similar brackets for wall attachment. In fact, as shown in FIGS. 16-18, one of the two edges in correspondence of which the bracket 110 is provided with properly shaped slots (in particular, the right edge in correspondence of which the properly shaped slots 113 are placed) is provided with projecting sliders 117, while the opposite edge of the bracket 110 (in particular, the left edge in correspondence of which the properly shaped slots 112 are placed) is provided with projecting hollow guides 116: the projecting sliders 117 of a bracket 110-1 are configured to slide in the projecting hollow guides 116 of a bracket 110-2 (as shown in FIG. 16*b*) until they reach a stop position, so that the two brackets 110-1 and 110-2 are adjacent to each other and mutually coupled (as shown in FIG. 17). Also, one of the two edges provided with the teeth 114 and 115 of the bracket 110 (in particular, the upper edge provided with the teeth 114 and notches 160) is provided with recesses 121 provided with projecting discs 118, while the opposite edge of the bracket 110 (in particular, the lower edge provided with the teeth 115) is provided with projecting gripper elements 119: the projecting gripper elements 119 of a bracket 110-2 are configured to receive and lock the projecting discs 118 of the recesses 121 of a bracket 110-3, so that the two brackets 110-2 and 110-3 are adjacent to each other and mutually coupled (as shown in FIG. 18). In particular, thanks to the fact that the projecting discs 118 are within recesses 121 of the respective edge causes, when the two brackets 110-2 and 110-3 are coupled to each other, that there is no unused space between them (i.e. the respective edges are in contact with each other). However, it must be noted that further embodiments of the foldable shelf according to the invention may have the bracket deprived of said recesses, whereby the projecting discs 118 are outside the respective edge of the same bracket 110.

Other embodiments of the foldable shelf according to the invention may have the projecting sliders and the respective projecting hollow guides which are differently positioned on the edges of the brackets with respect to the arrangement shown in the Figures (e.g. by reversing the edges), and/or that the projecting gripper elements and the respective projecting discs are differently positioned on the edges of the brackets with respect to the arrangement shown in the Figures (e.g. by reversing the edges). Further embodiments of the foldable shelf according to the invention may have only one type of reciprocal coupling between brackets selected out of the projecting slider-projecting hollow guide assembly and the projecting gripper element-projecting disc assembly.

Furthermore, as shown in FIG. 19, it is also possible to mount stroke limiting elements 150 to the (lower) end of the projecting hollow guides 116 (or even at an intermediate position of the projecting hollow guides 116) to allow the correct mounting of brackets even different from the brackets 110, such as for instance brackets 400 for diluting apparatuses also provided with projecting sliders 117' (and possibly with projecting hollow guides 116') similar to those of the bracket 110 and, consequently, configured to slide in the projecting hollow guides 116 of a bracket 110. In this case, the stroke limiting elements 150 limit the stroke of the projecting sliders 117' into the projecting hollow guides 116.

Figure 20:
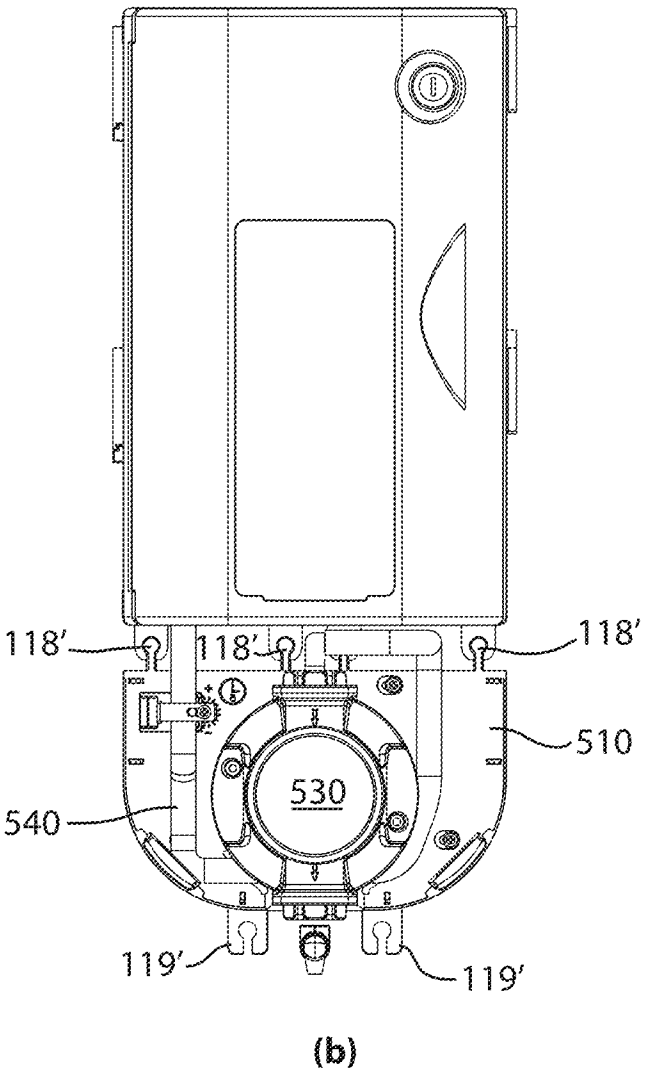
Figure 20:
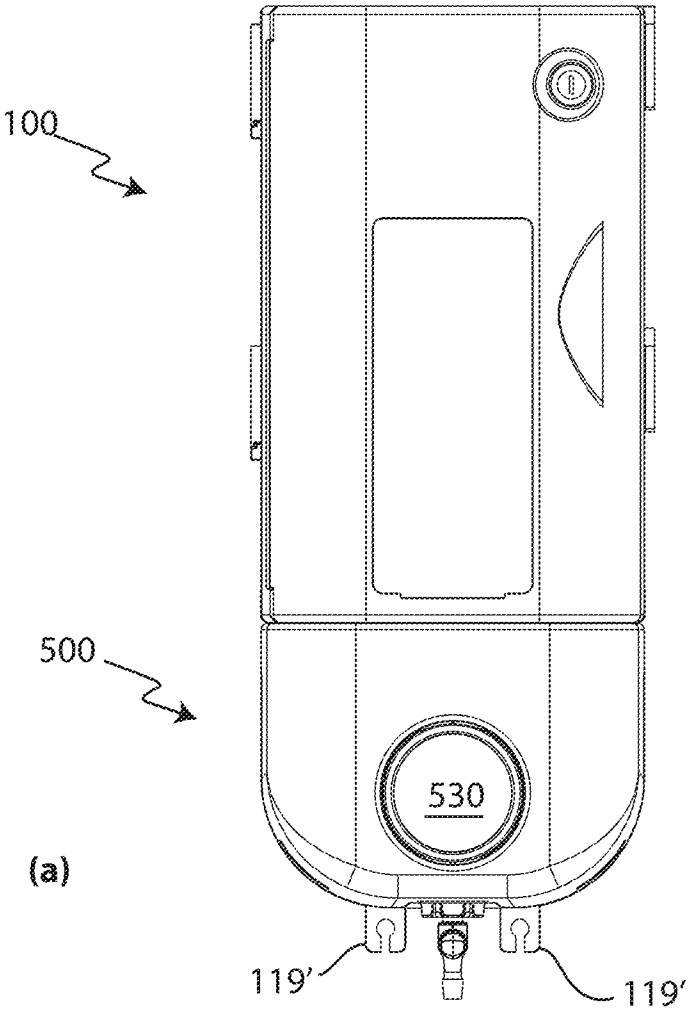

By way of example, as shown in FIG. 20, the foldable shelf 100 may be also coupled to a dispensing apparatus 500 mounted on a bracket 510 provided at the upper edge (configured to be positioned in proximity of the lower edge of the bracket 110 of the foldable shelf 100) with projecting discs 118' similar to the projecting discs 118 of the bracket 110 of the foldable shelf 100, whereby the projecting gripper elements 119 of the latter are configured to receive and lock the projecting discs 118' of the bracket 510 of the dispensing apparatus 500; also, the bracket 510 of the dispensing apparatus 500 is advantageously provided at the lower edge with projecting gripper elements 119' similar to the projecting gripper elements 119 of the bracket 110 of the foldable shelf 100, whereby the projecting gripper elements 119' of the former are configured to receive and lock the projecting discs 118 of the latter (e.g., to couple to a further foldable shelf 100) or to receive and lock similar projecting discs of a bracket supporting other components or devices, such as for instance a drip collection tray that serves in the case of filling a bottle. The dispensing apparatus 500 is provided with a mechanically operated pump 520, through an operation button 530, the inlet duct 540 of which is inserted into the container placed in the foldable shelf 100 and containing the liquid to dispense (e.g. soap). In particular, the two side walls 122 and 123 are provided with first portions 144 and 145, respectively, and second portions 146 and 147 (having area smaller than that of the first portions 144 and 145), respectively, which are delimited by cut-out lines, whereby they are easily removable with a simple tool (e.g. a screwdriver); similarly, the two end walls 124 and 125 are provided with third portions 148 and 149 (having area equal to that of the second portions 146 and 147), respectively, also delimited by cut-out lines which render their removal easy. In particular, number, shape and area of the removable portions are not essential features for the invention. Therefore, by removing one of the removable portions 149 of the bottom end wall 125 of the foldable shelf 100, it is possible to insert the inlet duct 540 of the pump 520 into the container placed in the foldable shelf 100. FIG. 20*c*

Figure 21:
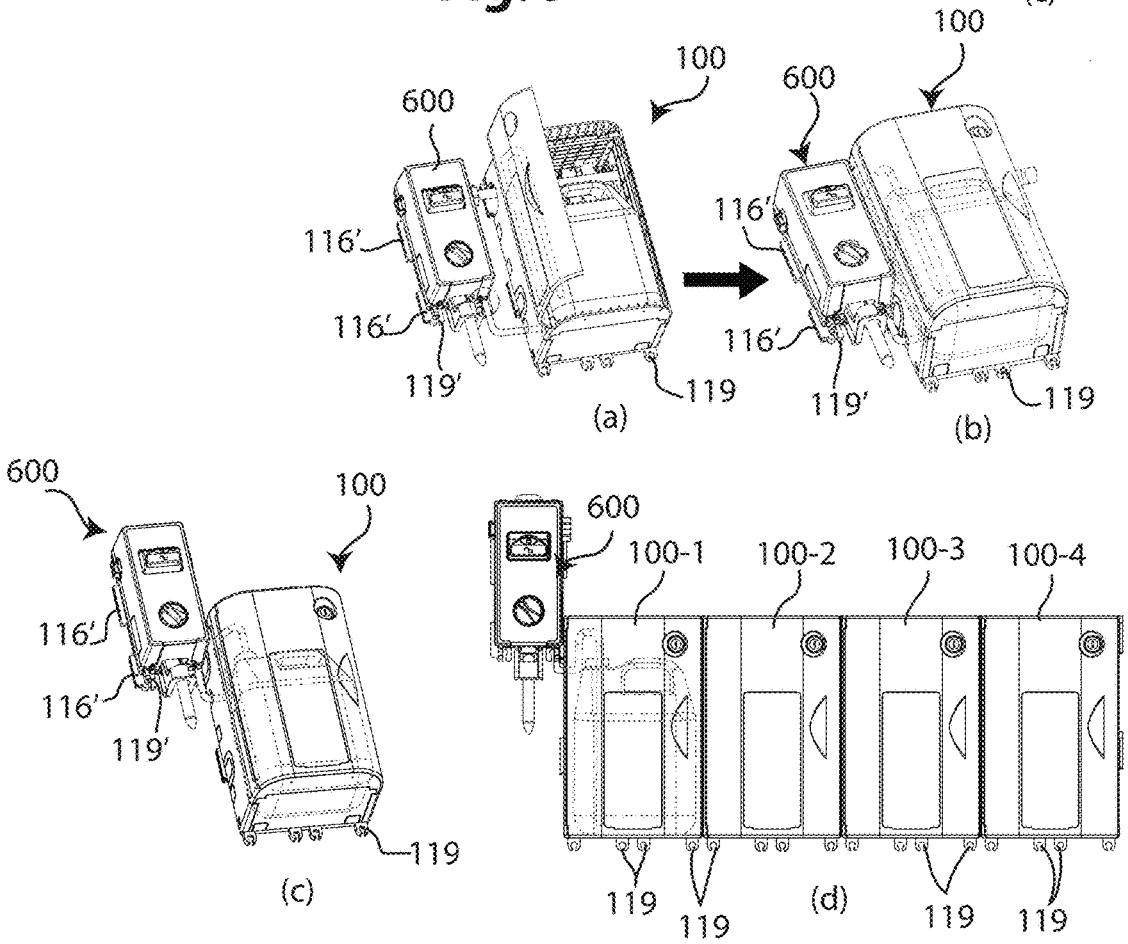

Still by way of example, as shown in FIG. 21, the foldable shelf 100 may be also coupled to a diluting apparatus 600, or alternatively to a dosing pump, (mounted on a bracket provided with projecting hollow guides 116', projecting sliders 117', projecting discs 118' and gripper elements 119' similar to those of the bracket 110 of the foldable shelf 100), the ducts of which are inserted into the foldable shelf 100 through the spaces created on the two side walls by removing one or more removable portions of at least one of these.

It is evident that the foldable shelf 100 is arranged to be mounted with other foldable shelves or with other components virtually in infinite combinations, ensuring the flexibility necessary to solve most problems of actual installations raising when the installation spaces are awkward and/or limited, obtaining compact and simple combinations. In particular, the coupling among the brackets 110 of various foldable shelves (and with brackets of other components, such as for instance diluters, dispensers and dosing pumps) allows to facilitate installation, simultaneously decreasing the number of wall plugs needed to attach the combination to a wall.

The preferred embodiments of this invention have been described and a number of variations have been suggested hereinbefore, but it should be understood that those skilled in the art can make other variations and changes without so departing from the scope of protection thereof, as defined by the attached claims.

The invention claimed is:

1. A foldable shelf for storing objects, in particular for storing liquid containers, comprising:

a bracket configured to be attached to a wall and a foldable box including a supporting frame comprising two ledges, which are parallel to each other and integrally connected to each other through two connecting bars, wherein the foldable box further comprises a pair of first walls and a pair of second walls, each one of the first walls being hinged along a first edge to a respective bar of the two connecting bars, whereby each one of the first walls is configured to assume an angular position ranging from a first limit angular position, wherein a second edge of the first wall opposite to the first edge is at a minimum distance from the two ledges, to a second limit angular position, wherein the second edge is at a maximum distance from the two ledges, each one of the second walls being hinged along a first edge to a respective ledge selected out of the two ledges, whereby each one of the second walls is configured to assume an angular position ranging from a first limit angular position, wherein a second edge of the second wall opposite to the first edge is at a minimum distance from the two connecting bars, to a second limit angular position, wherein the second edge is at a maximum distance from the two connecting bars;

wherein the foldable box is configured to assume a fully folded configuration when the first and second walls are at the respective first limit angular positions; and wherein the foldable box is configured to assume an operative configuration when the first and second walls are at the respective second limit angular positions, wherein the first and second walls are respectively provided with first and second mechanical stabilising elements configured to mutually interact with each other to cause the first and second walls to stably maintain their respective second limit angular positions, a first pair of walls selected out of the pair of first walls and the pair of second walls being provided with projecting elements configured to slide, when the foldable box assumes its operative configuration, in corresponding slots of the bracket along a coupling linear direction until the projecting elements reach a lock position wherein the foldable box is stably attached to the bracket and the foldable shelf assumes an operative configuration, wherein the bracket is provided with elastic locking elements configured to interact with the other pair of walls selected out of the pair of first walls and the pair of second walls to cause the foldable shelf to stably assume its operative configuration, and wherein the supporting frame is provided with at least one door hinged to one selected out of the two connecting bars or to one selected out of the two ledges, said at least one door being configured to assume a closed configuration when the foldable shelf is in said operative configuration.

2. The foldable shelf according to claim 1, wherein said at least one door is provided with a lock configured to lock said at least one door in its closed configuration.

3. The foldable shelf according to claim 1, wherein said at least one door is provided with a transparent panel.

4. The foldable shelf according to claim 1, wherein, when the foldable shelf assumes said operative configuration and is closed, at least part of the first and second mechanical stabilising elements and at least part of the elastic locking elements are inaccessible from outside.

5. The foldable shelf according to claim 1, wherein the first pair of walls consists of the pair of first walls and the other pair of walls consists of the pair of second walls.

6. The foldable shelf according to claim 5, wherein said projecting elements are positioned in correspondence with the second edges of each one of the second walls, and wherein each one of the corresponding slots of the bracket comprises a receiving portion and a locking portion, wherein the receiving portion has a width larger than a width of the locking portion, each one of the projecting elements having a planar end, having a width larger than the width of the locking portion, that is configured to insert into the receiving portion and to cause the projecting element to slide from the receiving portion to the locking portion, where the planar end is configured to interact with the locking portion to cause the respective projecting element to be stably locked into the corresponding slot.

7. The foldable shelf according to claim 5, wherein said elastic locking elements comprise at least one pair of teeth positioned along each one of two edges of the bracket configured to come into contact with the second walls when the foldable shelf assumes its operative configuration, wherein said at least one pair of teeth are directed towards the inside of the foldable shelf when the foldable shelf assumes its operative configuration, said at least one pair of teeth being configured to elastically bend towards the outside of the foldable shelf when the foldable shelf assumes its operative configuration, wherein said at least one pair of teeth are configured to assume a rest position at which they interact with the second walls, whereby said at least one pair of teeth are configured to prevent the second walls from mutually sliding with respect to the bracket along the coupling linear direction and a direction opposite to the coupling linear direction when the foldable shelf assumes its operative configuration.

8. The foldable shelf according to claim 5, wherein the second walls are provided with ribs having projecting ends which project from the second edges of the second walls, the projecting ends of the ribs of one selected out of the second walls being configured to insert into corresponding edge notches of the bracket, and the projecting ends of the ribs of the other one selected out of the second walls being configured to insert and slide in corresponding linear slots of the bracket until getting into contact with ends of the corresponding linear slots, whereby the corresponding edge notches and the ends of the corresponding linear slots of the bracket are configured to prevent the projecting ends of the ribs of the second walls from sliding with respect to the bracket along the coupling linear direction when the foldable shelf assumes its own operative configuration.

9. The foldable shelf according to claim 5, wherein said first mechanical stabilising elements comprise:

one or more teeth located on each one of the first walls opposite to the first edge of the respective first wall, said one or more teeth being directed towards the inside of the foldable shelf when the foldable shelf assumes its operative configuration and configured to elastically bend towards the outside of the supporting frame of the foldable box, and a plurality of alignment pins with which each one of the first walls is provided along two respective third edges, joining the first and second edges of the respective first wall, wherein the alignment pins are directed towards the inside of the foldable shelf when the foldable shelf assumes its operative configuration, and wherein said second mechanical stabilising elements comprise:

a plurality of slots with which each one of the second walls is provided along two respective third edges, joining the first and second edge of the respective second wall, wherein, when the foldable box assumes the operative configuration, the two third edges of each one of the first walls are configured to come into contact with corresponding third edges of the pair of second walls so that the respective alignment pins insert into corresponding slots of the two corresponding third edges of the second walls, and said one or more teeth with which each one of the first walls is provided are configured to assume a rest position at which they interact with the corresponding third edges, whereby said one or more teeth are configured to lock the second walls in the respective second limit angular positions.

10. The foldable shelf according to claim 9, wherein said one or more teeth are two or more teeth.

11. The foldable shelf according to claim 1, wherein one or more walls selected out of the first walls and the second walls are provided with one or more removable portions delimited by cut-out lines.

12. The foldable shelf according to claim 1, wherein the bracket is provided with:

one or more projecting sliders, and one or more projecting hollow guides, wherein said one or more projecting sliders and said one or more projecting hollow guides are arranged along at least two edges of the bracket opposite to each other, each projecting slider being configured to insert into a hollow guide identical to one of said one or more projecting hollow guides until reaching a stop position, whereby the bracket is configured to be mounted in a modular way to one or more external brackets provided with at least one slider identical to one of said one or more projecting sliders and/or with at least one hollow guide identical to one of said one or more projecting hollow guides.

13. The foldable shelf according to claim 12, further comprising at least one stroke limiting element configured to be mounted onto one of said one or more projecting hollow guides and to limit a stroke of a slider identical to one of said one or more projecting sliders.

14. The foldable shelf according to claim 1, wherein the bracket is provided with:

one or more projecting discs, and one or more projecting gripper elements, wherein said one or more projecting discs and said one or more projecting gripper elements are arranged along at least two edges of the bracket opposite to each other, each projecting gripper element being configured to receive and lock a disc identical to one of said one or more projecting discs, whereby the bracket is configured to be mounted in a modular way to one or more external brackets provided with at least one disc identical to one of said one or more projecting discs and/or with at least one gripper element identical to one of said one or more projecting gripper elements.

15. The foldable shelf according to claim 14, wherein said one or more projecting discs are positioned in corresponding edge recesses of the bracket.

16. The foldable shelf according to claim 1, wherein at least one selected out of the bracket and the foldable box is made of plastic material.

* * * * *